US010099107B2

(12) United States Patent
Liang et al.

(10) Patent No.: US 10,099,107 B2
(45) Date of Patent: Oct. 16, 2018

(54) PROTECTIVE SPORTING GEAR

(71) Applicant: Compression Armor LLC, Huntington Beach, CA (US)

(72) Inventors: Steven Liang, Huntington Beach, CA (US); Marco Galli, Yorba Linda, CA (US)

(73) Assignee: COMPRESSION ARMOR LLC, Huntington Beach, CA (US)

( * ) Notice: Subject to any disclaimer, the term of this patent is extended or adjusted under 35 U.S.C. 154(b) by 331 days.

(21) Appl. No.: 14/997,444

(22) Filed: Jan. 15, 2016

(65) Prior Publication Data

US 2017/0151486 A1 Jun. 1, 2017

Related U.S. Application Data

(60) Provisional application No. 62/261,236, filed on Nov. 30, 2015.

(51) Int. Cl.

| | |
|---|---|
| ***A41D 3/06*** | (2006.01) |
| ***A63B 71/12*** | (2006.01) |
| ***A41D 13/05*** | (2006.01) |
| ***A41D 13/08*** | (2006.01) |

(52) U.S. Cl.

CPC ..... *A63B 71/12* (2013.01); *A41D 3/06* (2013.01); *A41D 13/0506* (2013.01); *A41D 13/0518* (2013.01); *A41D 13/0543* (2013.01); *A41D 13/08* (2013.01); *A63B 71/1216* (2013.01); *A63B 71/1225* (2013.01); *A63B 2071/125* (2013.01); *A63B 2071/1233* (2013.01); *A63B 2071/1241* (2013.01); *A63B 2071/1258* (2013.01)

(58) Field of Classification Search

CPC ..... A41D 13/0518; A41D 3/06; A63B 71/12

See application file for complete search history.

(56) References Cited

U.S. PATENT DOCUMENTS

| | | | | |
|---|---|---|---|---|
| 9,839,251 | B2 * | 12/2017 | Pannikottu | A42B 3/121 |
| 2008/0113143 | A1 * | 5/2008 | Taylor | A41D 31/005 428/47 |
| 2008/0172779 | A1 * | 7/2008 | Ferguson | A41D 31/005 2/455 |
| 2016/0353825 | A1 * | 12/2016 | Bottlang | B32B 3/12 |

* cited by examiner

*Primary Examiner* — Tejash Patel
(74) *Attorney, Agent, or Firm* — Rutan & Tucker, LLP

(57) ABSTRACT

A protective sporting gear is described with a plurality of polygon-shaped protective components interposed between a first layer of material and a second layer of material. The plurality of polygon-shaped protective components are attached to a top surface of the first layer of material. Each of the plurality of protective components includes one or more polygon-shaped layers of rigid material situated on one or more polygon-shaped layers of non-rigid material. A bottom surface of a first polygon-shaped layer of non-rigid material of the one or more polygon-shaped layers of non-rigid material is attached to the top surface of the first layer of material.

20 Claims, 21 Drawing Sheets

PROTECTIVE SPORTING GEAR

CROSS-REFERENCE TO RELATED APPLICATIONS

This application claims the benefit of priority on U.S. Provisional Application No. 62/261,236, filed Nov. 30, 2015, the entire contents of which are incorporated by reference.

FIELD

Embodiments of the disclosure relate to the field of sporting equipment. More specifically, one embodiment of the disclosure relates to a wearable, protective sporting gear.

GENERAL BACKGROUND

There are a number of sports in which protective equipment may be worn by players to protect them from injury. Currently, ice hockey players wear shoulder pads to protect his/her upper torso along with one-piece shin guards and thigh pads. However, these conventional pads are bulky and may hamper movement by the player. Due to adverse effects on overall movement, many persons playing related cross-over recreation sports, such as roller hockey for example, forego wearing protective equipment. As a result, during competitive games, injuries may occur that could have been avoided if protective gear was worn.

Additionally, some protective equipment is bulky and, for certain individuals, hampers mobility. As a result, some athletes may not "wear the pads" better than others, and thus, these athletes may experience greater success on the field of play if they had other protective equipment options.

BRIEF DESCRIPTION OF THE DRAWINGS

Embodiments of the invention are illustrated by way of example and not by way of limitation in the figures of the accompanying drawings, in which like references indicate similar elements and in which.

DETAILED DESCRIPTION

Figure 1A:
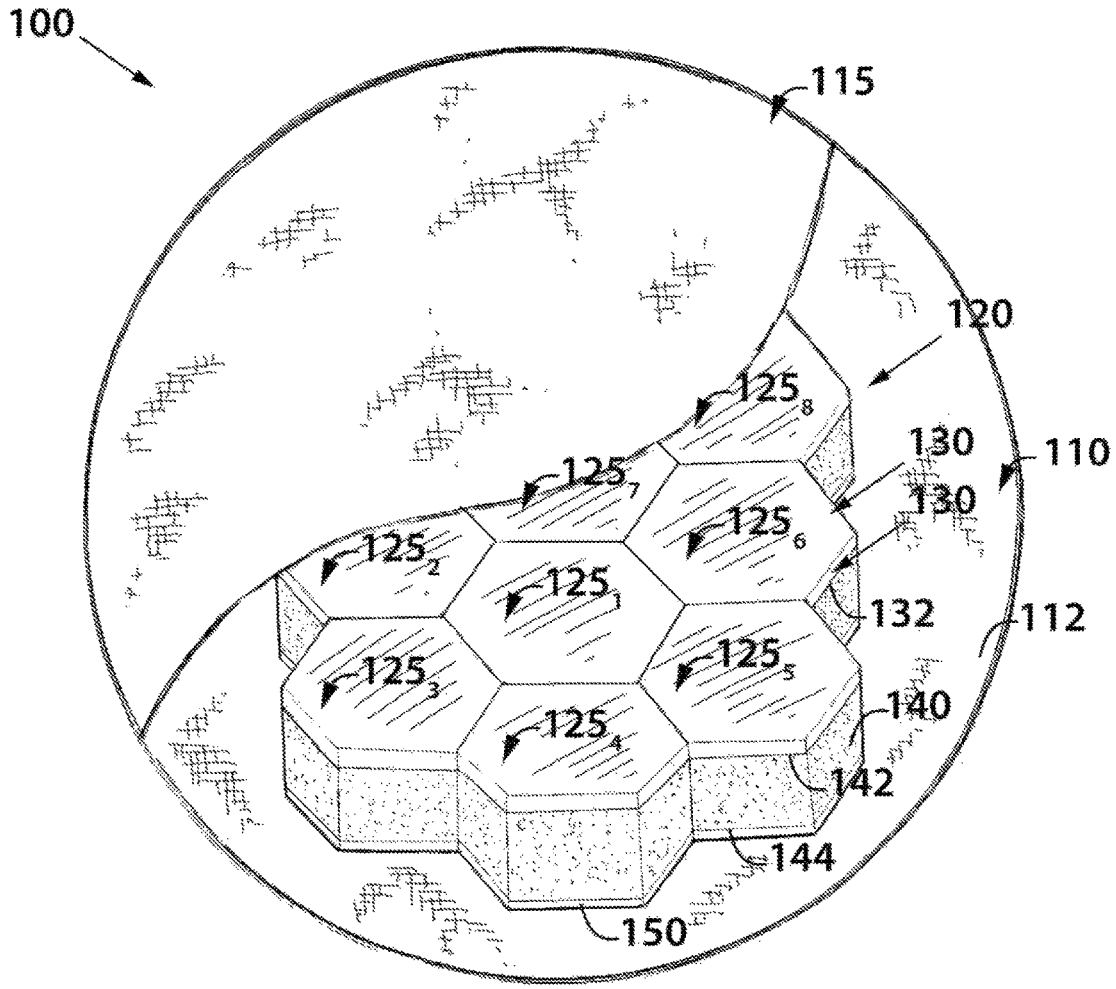
FIGS. 1A-1D are illustrative embodiments of protective components implemented as part of sporting gear worn by an individual.

Various embodiments of the disclosure relate to wearable, protective sporting gear that allows for improved player mobility over conventional protective sporting gear. Herein, according to one embodiment, the protective sporting gear features an array of protective components interposed between a top layer of material and a bottom layer of material. The top layer and/or bottom layer of the material may include a fabric that is stretchable in multiple directions, including compression fabric and/or a type of fabric (e.g., a high-performance, microfiber, polyester fabric) that wicks moisture on an athlete's skin from an inner side of the fabric to an outer side of the fabric for evaporation (collectively referred to as "compression/wicking fabric"). It is contemplated that the top layer of material may be equivalent to the type of material used as the bottom layer. Of course, it is contemplated that the top layer of material may differ from the type of material used as the bottom layer. Herein, for ease of description, the top layer and the bottom layer correspond to the same material (sometimes referred to as the "base material").

Herein, each protective component is attached at least to an upper surface of the bottom layer of the base material. According to one embodiment of the disclosure, a protective component features one or more layers of rigid material (hereinafter, "rigid material layer(s)") positioned on one or more layers of non-rigid material (hereinafter, "non-rigid material layer(s)"). The rigid material layer(s) may include light-weight composite material, such as a hardened plastic for example. The non-rigid material layer may include a more flexible material than the composite material, such as a foam for example. Each protective component may be coupled to a plurality of neighboring protective components, although it is contemplated that each protective component may be independent of (and no coupling with) any neighboring protective components.

In one embodiment, the rigid material layer(s) may be positioned on and patterned to vertically align with the non-rigid material layer(s). As a result, each vertically oriented side of the layered protective component, which includes an edge along a perimeter of the rigid material layer(s), is also planar with a corresponding vertically oriented side of the non-rigid material layer(s). The depth of the rigid material layer(s) is normally less than a depth of the non-rigid material layer(s). In another embodiment, however, the rigid material layer(s) of the protective component may be positioned on the non-rigid material layer(s), but the perimeter of the rigid material layer is lesser in size than the perimeter of the non-rigid material layer. As a result, the rigid material layer resides within a boundary formed by the perimeter of the non-rigid material layer.

More specifically, the array of protective components may include a plurality of protective components arranged in a prescribed pattern. Herein, each protective component has a polygon shape (e.g., hexagon) and features one or more rigid material layers and one or more non-rigid material layers. The one or more rigid material layers (e.g., hardened plastic) are similarly patterned as the one or more non-rigid material layers positioned in a stacked formation during manufacturing. It is contemplated that an optional layer of adhesive material may be disposed on a bottom surface of a layer of non-rigid material to assist in adhesion of the protective component to a specific area of the base material that is part of an item of sporting gear (e.g., shin protector, sport girdle, tights, etc.).

Herein, the terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

As this invention is susceptible to embodiments of many different forms, it is intended that the present disclosure is to be considered as an example of the principles of the invention and not intended to limit the invention to the specific embodiments shown and described.

I. General Architecture—Protective Components (Protective Hexagons)

Referring to FIGS. 1A-1D, illustrative embodiments of protective sporting gear 100 are shown. The protective sporting gear 100 features an array of protective components 120, which is configured to be attached to a first layer of material 110. As shown, each protective component $\mathbf{125}_1$-$\mathbf{125}_N$ (N≥1) is adhered to the first (bottom) layer of material 110 covered by a second (top) layer of material 115. The first layer of material 110 may be any type of fabric, especially a compression/wicking fabric that is intended to wick sweat, reduce muscle vibration during activities thereby preventing premature muscle fatigue or damage, and/or increase blood flow and oxygen to working muscles, which increases muscle performance and thereby endurance. One type of this compression/wicking fabric is Nike® DRI-FIT® fabric. It is contemplated that the second layer of material 115 may be the same or a different type of fabric than the first layer of material 110.

Herein, each protective components $\mathbf{125}_1$-$\mathbf{125}_N$ of the array of protective components 120 may be configured as a hexagonal shaped component, where the array of protective components 120 is arranged so that some or all of the sides of the hexagonal shaped protective component (e.g., protective component $\mathbf{125}_1$) are aligned with (and flush against) sides of at least two neighboring protective components (e.g., protective components $\mathbf{125}_2$ and $\mathbf{125}_3$). Each of the protective components $\mathbf{125}_1$-$\mathbf{125}_N$ includes one or more layers of rigid material 130 (hereinafter "rigid material layer(s)") and one or more layers of non-rigid material 140 (hereinafter "non-rigid material layer(s)").

For example, with respect to protective component $\mathbf{125}_5$ for example, although most or all of the protective components $\mathbf{125}_1$-$\mathbf{125}_N$ have the same construction, the rigid material layer(s) 130 may include a light-weight, hardened composite, which may include a high, medium or low density plastic (e.g., a type of Polyethylene). The non-rigid material layer(s) 140 may include a more flexible material such as a foam (e.g., an Ethylene-vinyl acetate) with a prescribed amount of density to provide sufficient compression and resiliency in response to an impact (e.g., a force applied to the rigid material layer(s) 130 and further applied to the non-rigid material layer(s) 140). For instance, in response to the degree of force applied, the flexible material may be compressed by at least 10% of its thickness (depth) and perhaps in a maximum range between 40%-80% of its thickness.

As shown, the rigid material layer(s) 130 and the non-rigid material layer(s) 140 are similarly patterned, aligned and positioned one atop of another during manufacturing. It is contemplated that an optional layer of adhesive material 150 may be disposed on a bottom surface 144 of the non-rigid material layer 140 (or the lowest surface of a non-rigid material layer if more than one non-rigid material layer is present) and/or on a top surface 112 of the first layer of material 110 in order to assist in adhesion of this particular protective components $\mathbf{125}_5$ to the first layer of material 110.

As further shown in FIGS. 1A-1D, for each protective component $\mathbf{125}_1$-$\mathbf{125}_N$, the rigid material layer(s) 130 and the non-rigid material layer(s) 140 are either cut, molded or punched into a regular polygon shape, such as a hexagon shape for example (e.g., all sides are equal—hexagon interior angle is 120° and exterior angle is 60°). As shown, the rigid material layer(s) 130 may be adhered chemically or welded (e.g., via heat or ultrasonic) to each other and/or the non-rigid material layer(s) 140, with the rigid material layer(s) 130 being the top of the stack and the non-rigid material layer(s) 140 being directly underneath. A bottom surface 132 of the rigid material layer 130 (or the lowest rigid material layer if more than one rigid material layer is present) and/or a top surface 142 of the non-rigid material 140 may have texture (e.g., one or more grooves) to help in adherence by allowing for additional adhesive there between. Additionally, a bottom surface 144 of the non-rigid material 140 (or the lowest non-rigid material layer if more than one non-rigid material layer is present) may have texture to help in adherence to the first layer of material 110.

This combination and order of materials absorbs the impact from other equipment, falls or collisions with other players. For instance, each of the protective components $\mathbf{125}_1$-$\mathbf{125}_N$ may include a single layer of rigid material 130 positioned on a single layer of non-rigid material 140 (see FIG. 1A). Alternatively, the protective components $\mathbf{125}_1$-$\mathbf{125}_N$ may include a single layer of rigid material 130 positioned on a plurality of layers of non-rigid material $\mathbf{145}_1$-$\mathbf{145}_M$ (M≥2), where the layers of non-rigid material 140 may feature foams of the same shape and/or the same or different density and/or elasticity (see FIGS. 1B-1D). As yet another alternative, the protective components $\mathbf{125}_1$-$\mathbf{125}_N$ may include a plurality of layers of rigid material 130 positioned on a single layer of non-rigid material 140, where each layer of rigid material 130 may have the same shape and/or the same or different densities. Lastly, as yet another alternative, the protective components $\mathbf{120}_1$-$\mathbf{120}_N$ may include a plurality of layers of rigid material 130 positioned on a plurality of layers of non-rigid material 140, where each layer of rigid material 130 may have the same shape and/or the same or different densities and the layers of non-rigid material 140 may feature foams of the same shape and/or the same or different density and/or elasticity.

As shown in FIG. 1A, the outside layer(s) of the protective component $\mathbf{125}_i$ (i=1, 2 . . . ) includes a layer of rigid material ("rigid material layer") 130, such as high, medium or low density plastic that offers rigidity and has a high degree of impact resistance from player equipment (including but not limited to hockey, lacrosse & field hockey sticks, lacrosse & field hockey balls, pucks, other player protective gear or footwear and wooden martial arts staffs). The inside layer(s) of the protective component $\mathbf{125}_i$ includes a layer of non-rigid material ("non-rigid material layer") 140, which may include a foam with a selected density that aids in the cushioning of impact from blows (from other player equipment, player collisions, or, game balls or pucks) or, falls received during the course of the activity, lessening the chances of receiving serious injury.

The array of protective components 120, referred to as "protective hexagons," includes a plurality of protective component $\mathbf{125}_1$-$\mathbf{125}_N$ that are coupled together, each protective component 120 having a polygon shape (e.g., hexagon) with horizontal-oriented top and bottom surfaces, along with vertically oriented edges equal in number to the polygon shape (e.g., six for a hexagon shaped protective component). The protective hexagons 120 are placed on and attached to the first layer of material 110 (e.g., compression/wicking fabric). The protective hexagons 120 are arranged and aligned (e.g., at least two slides flush with) to conform to the athlete's body for a better anatomic fit compared to the other traditional protective padding shapes.

Furthermore, for each protective component $125_i$, the rigid material layer 130 may be attached (e.g. by use of an adhesive, heat welding, etc.) to the non-rigid material layer 140. Each protective component $125_i$ can stack one on top of another, making columns, which then can interlock, side by side, in a brick-like pattern with other columns, leaving each piece to flex upward or downward on the each of the six sides. The shape and patterned ordering of the protective hexagons 120 cause no hindrance in natural or athletic movements during physical activity. If needed the regular hexagon shape can be made (cut—shaped—molded) to fill void spots to create a smooth edge of protection. A neighboring protective hexagon $120_1$ may be aligned with two or more (up to six) neighboring protective hexagons $1202_{2\text{-}7}$ in accordance with a pattern as shown.

The sizes, thickness and densities of the non-rigid material layer 140 and the rigid material layer 130 that form a protective component (e.g., protective component $125_5$) can be made larger or smaller, softer or harder, depending on the degree of protection needed or area of the body that needs protection. The size of the protective components $125_1$-$125_N$ can be manufactured to properly fit child, youth, junior and adult users, male or female.

In summary, FIG. 1A illustrates an exemplary embodiment of the protective sporting gear 100 that include protective hexagons 120 with a layer of rigid material (plastic) 130 that is sized and aligned with a layer of non-rigid material 140, which is illustrated as a layer of foam. The adhesive material 150 is positioned on a bottom surface 144 of the non-rigid material 140, where the adhesive material 150 is activated by an environmental factor, such as a specific amount heat, a liquid, or ultrasonic pulses. In response to placement on the first layer of material 110 (e.g., tubular shaped fabric lining for fitting on a leg, arm, neck, or head; fabric in the form of a shirt, sporting girdle, tights, etc.) and activation of the adhesive material 150, the protective hexagons 120 are attached to the first layer of material 110. It is contemplated that the rigid material 130 and non-rigid material 140 may be attached together by placement of an adhesive there between, perhaps the same or different than adhesive material 150. Alternatively, the rigid material 130 and non-rigid material 140 may be welded together through a heat and/or ultrasonic process.

Figure 1B:
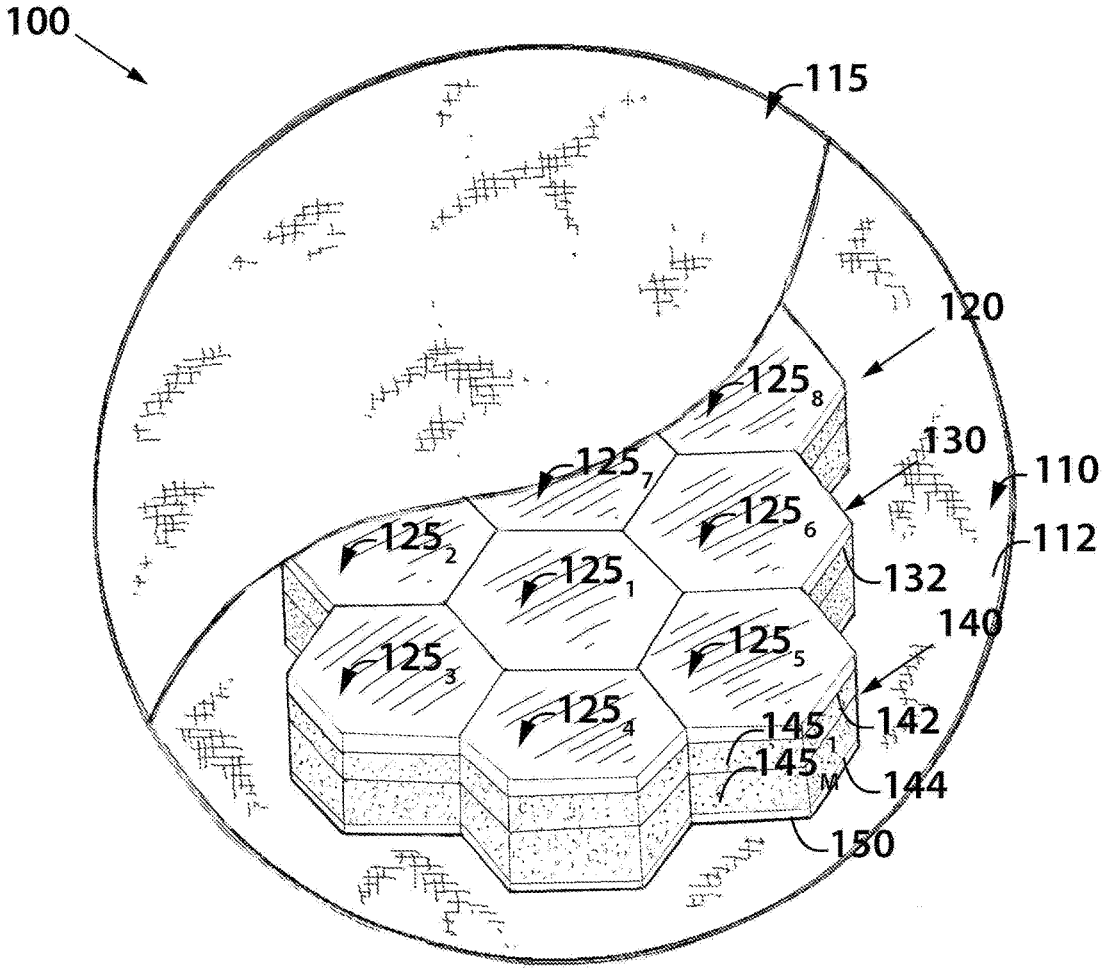

Referring now to FIG. 1B, a second illustrative embodiment of protective sporting gear 100 is shown. Herein, the protective sporting gear 100 features a plurality of protective components $125_1$-$125_N$, each with the rigid material (plastic) 130 that is sized and aligned with a plurality of non-rigid material layers $145_1$-$145_M$, each is illustrated as a layer of foam with the same or different densities. The adhesive material 150 is positioned on a bottom surface 144 of the non-rigid material layer $145_M$ that is furthest away from the rigid material layer 130. The adhesive material 150 is activated by an environmental factor, as described above. When placed on the first layer of material 110 (e.g., tubular shaped fabric lining for fitting on a leg, arm, neck, or head; fabric in the form of a shirt, sporting girdle, tights, or shorts, etc.) and the adhesive material 150 is activated, the protective hexagons 120 are attached to the top surface 112 of the first layer of (base) material 110. It is contemplated that the bottom surface 132 of the rigid material layer 130 and the top layer 142 of the non-rigid material layer $145_1$ may be attached together. One mechanism for attachment may be through an adhesive, perhaps the same or different than adhesive material 150. Of course, one non-rigid material layers $145_i$ may be attached to its neighboring non-rigid material layer $145_{i+1}$. Also, the non-rigid material layers $145_1$-$145_M$ of a particular protection component (e.g., protection component $125_1$) may be attached to corresponding non-rigid material layers $145_1$-$145_M$ of any neighboring (bordering) protection components (e.g., protection component $125_2$-$125_7$).

Figure 1C:
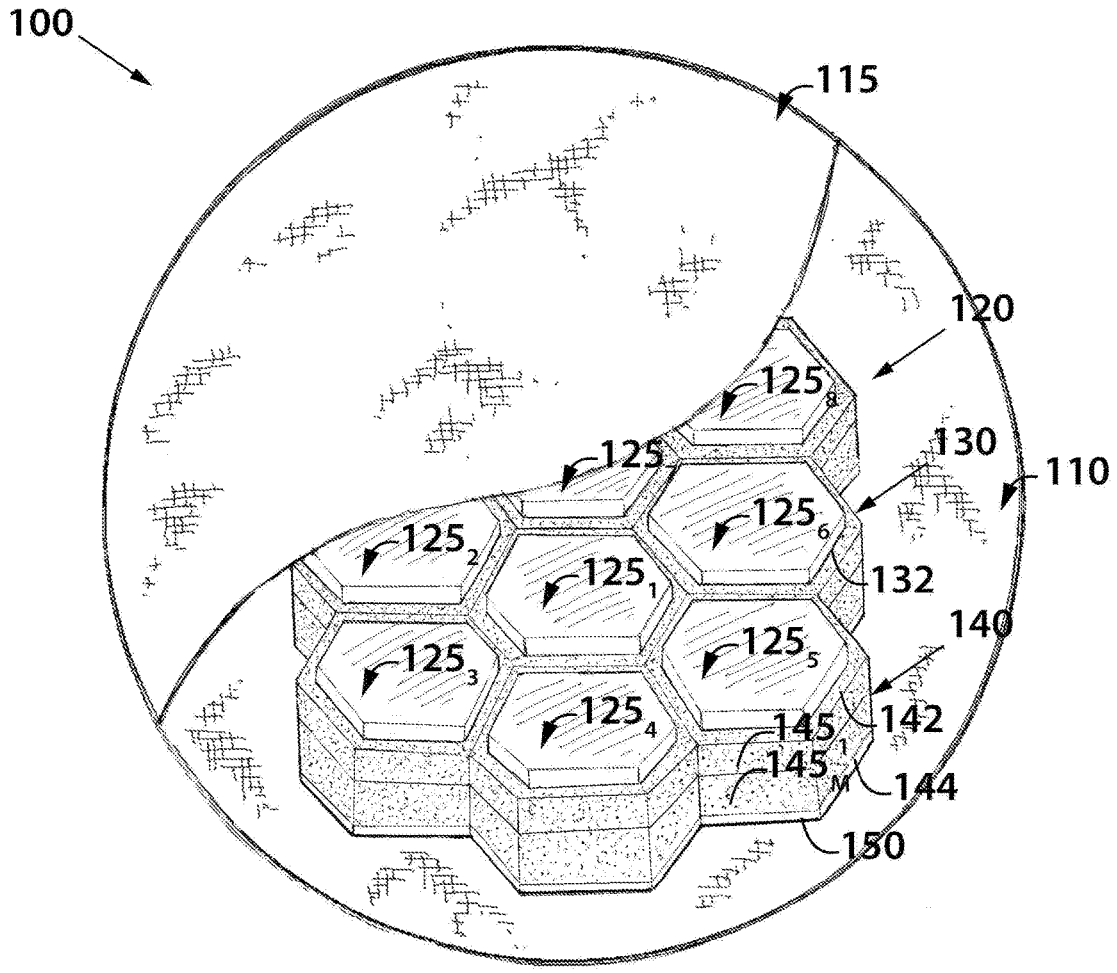

Referring now to FIG. 1C, a third illustrative embodiment of protective sporting gear 100 is shown. Herein, the protective sporting gear 100 features a plurality of protective components $125_1$-$125_N$, each with the rigid material (plastic) 130 that is lesser sized (e.g., area and/or perimeter) than the non-rigid material layer(s) (e.g., non-rigid material layers $145_1$-$145_M$), where the non-rigid material layers $145_1$-$145_M$ are illustrated as layers of foam with the same or different densities. Hence, the rigid material layer 130 resides within a perimeter of at least one of the non-rigid material layers $145_1$-$145_M$. The adhesive material 150 is positioned on the bottom surface 144 of the non-rigid material layer $145_M$ that is furthest away from the rigid material 130, where the adhesive material 150 is activated by an environmental factor, as described above.

When placed on the first layer of material 110 (e.g., tubular shaped fabric lining for fitting on a leg, arm, neck, or head; fabric in the form of a shirt, sporting girdle, tights, etc.) and activation of the adhesive material 150, the protective hexagons 120 become attached to the first layer of material 110. It is contemplated that the rigid material layer 130 and the top surface 144 of the non-rigid material layer $145_1$ are attached together, perhaps with the same or different than adhesive material 150. Of course, one non-rigid material layers $145_i$ may be attached to its neighboring non-rigid material layer $145_{i+1}$, and the non-rigid material layers $145_1$-$145_M$ of a particular protection component (e.g., protection component $125_1$) may be attached to corresponding non-rigid material layers $145_1$-$145_M$ of any neighboring (bordering) protection components (e.g., protection component $125_2$-$125_7$).

Figure 1D:
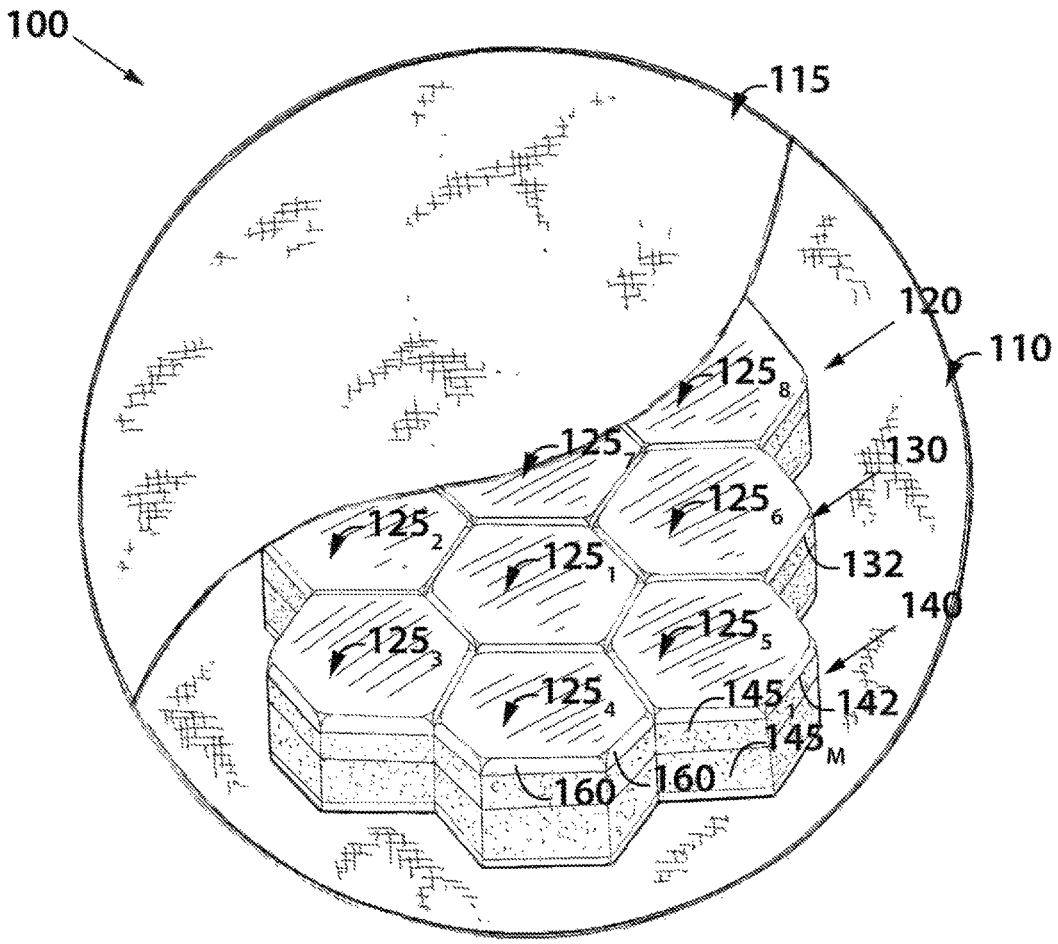

Referring now to FIG. 1D, a fourth illustrative embodiment of protective sporting gear 100 is shown, where the configurations of the protective components $125_1$-$125_N$ forming the protective hexagons 120 is similar to the configuration set forth in FIG. 1B. However, each of the protective components $125_1$-$125_N$ is configured with the rigid material layer 130 having tapered, smooth edges 160, which may be utilized for the embodiments illustrated in FIGS. 1A-1C as well. The rigid material layer 130 is positioned on one or more layers of the non-rigid material 140. When deployed as a plurality of layers of non-rigid material $145_1$-$145_M$, each of these non-rigid material layers may be a layer of foam with the same or different densities. It is contemplated that the tapered edges 160 of the non-rigid material 130 may be tapered differently, where the bottom surface 132 of the rigid material layer 130 that attaches to the top surface 142 of a bordering non-rigid material layer (e.g., a first non-rigid material $145_1$) is lesser in area and the point of attachment is centralized and away from the perimeter of the first non-rigid material $145_1$. Therefore, the tapered edge would be an inward tapered in lieu of an outward tapering as shown in FIG. 1D.

II. Protective Knee/Shin Protector

Figure 2A:
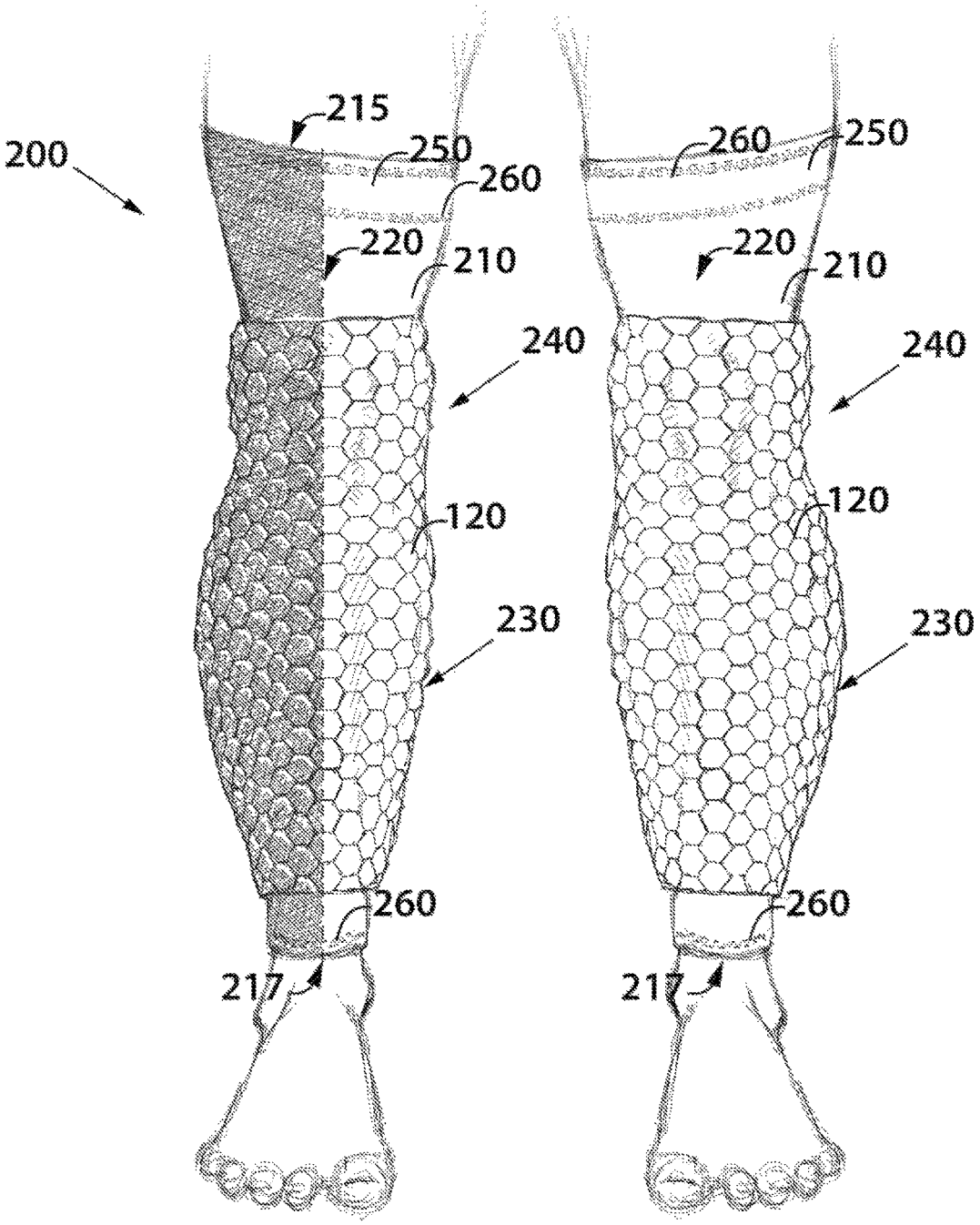
FIGS. 2A-2C are exemplary embodiments of the protective components of FIGS. 1A-1D implemented as part of a knee/shin protector.
Figure 2B:
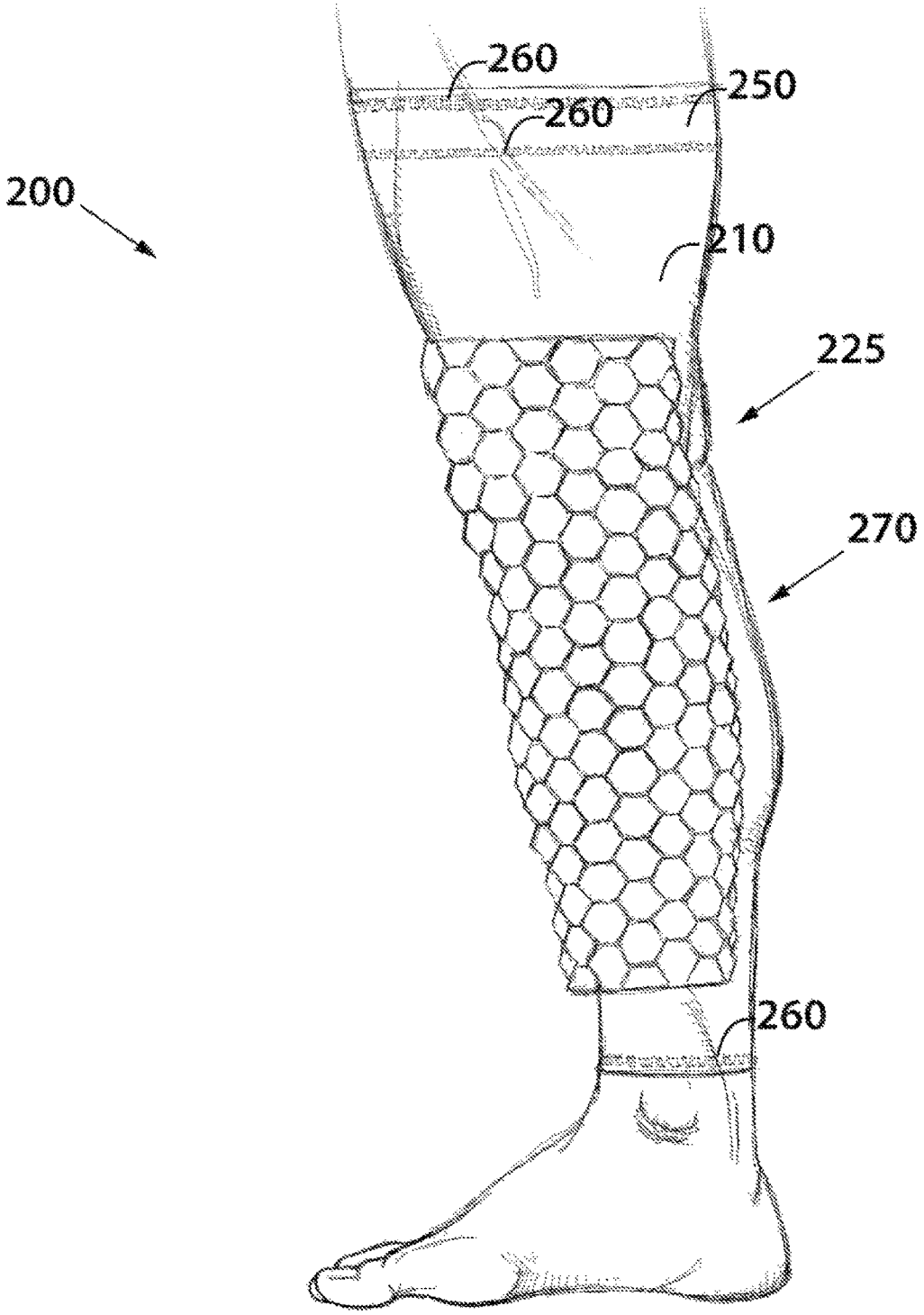
Figure 2C:
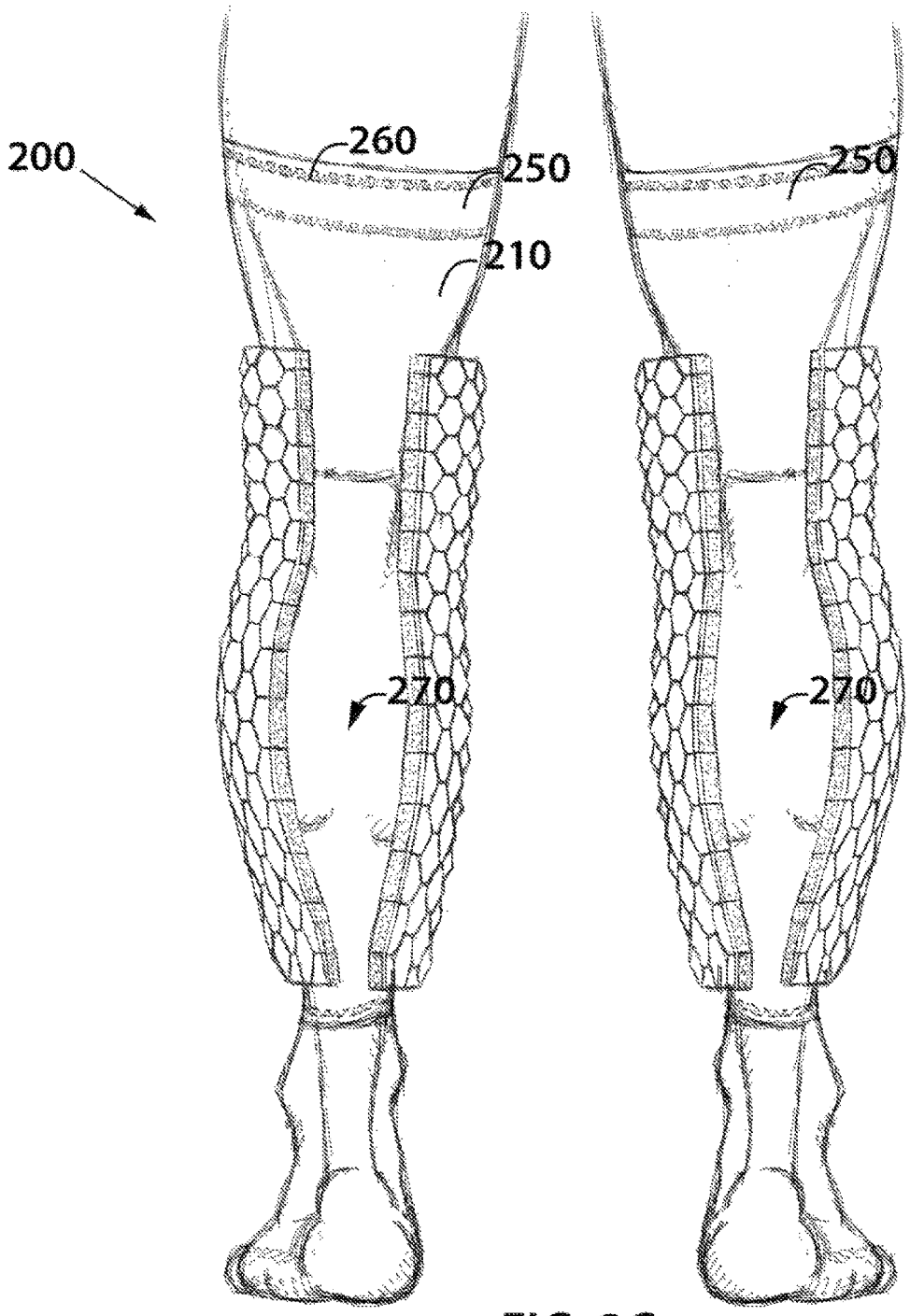

Referring now to FIGS. 2A-2C, an exemplary embodiment of protective sporting gear as a knee/shin protector 200 is shown. The knee/shin protector 200 includes two layers of material (e.g., pieces or sheets of compression/wicking fabric); namely, the first layer of material 110 and the second layer of material 115 (as shown in a cut-away view) collectively form a cylindrical sleeve 210. The first layer of material 110 has the protective hexagons 120 attached thereto. The protective hexagons 120 can be attached (e.g., sewn, glued, welded, or any other adhesion scheme) to completely or partially cover the first layer of material 110, depending on what degree of protection and what area is needed of protection.

For example, where the knee/shin protector 200 is for use in ice or roller hockey, the protective hexagons 120 may be attached to the first layer of material 110 forming the sleeve 210. The protective hexagons 120 may extend from a front side 220 of the sleeve 210 to cover portions of a leg above the ankle up to and a knee as shown in FIG. 2A. Hence, the protective hexagons 120 are arranged to cover an entirety of the shin area 230 and/or the knee area 240.

Herein, the second layer of material 115 (e.g., outer compression/wicking fabric) may be attached to the first layer of material 110 with the protective hexagons 120 encased between these layers 110 and 115. The second layer of material 115 ensures that the protective hexagons 120 stay together, thereby controlling gaps and providing compression. An elastic band 250 is attached as part of a top opening 215 and/or a bottom opening 217 of the sleeve 210 to retain positioning of the knee/shin protector 200 during use. Also, flat stitching 260 would be used where sewing is needed to minimize or eliminate skin discomfort.

As shown in FIG. 2A, the protective hexagons 120 may be positioned to cover the shin area 230. However, as shown in FIGS. 2B-2C, at least a portion of a back side 225 of the sleeve 210, which covers a calf area 270 of the user when worn, is devoid of any protective hexagons 120. This avoids hindrance of movement by the user when the knee/shin protector 200 is worn.

It is contemplated that slight modifications may be made to the knee/shin protector 200 based on the sport targeted for such use. For example, in soccer or field hockey, the protective hexagons 120 could just cover and protect the shin area 230, but not the knee area 240. This may be accomplished by attaching the protective hexagons 120 to the first layer of material 110 so as to reside on a middle portion of the sleeve 210. For activities such as broomball, roller hockey, ice hockey or even floor hockey, the protective hexagons 120 could just cover and protect the shin area 230 and the knee area 240. For mixed martial arts, however, the protective hexagons 120 would cover the knee area 240, the shin area 230 and even extend over a top portion of the user's foot. The shape of the protective hexagons 120 can also be larger or smaller in dimension, and the non-rigid material of the protective hexagons 120 may have a prescribed density that provides more or less cushion, depending on the sport and user preference.

III. Protective Sport Girdle

Referring now to FIGS. 3A-3D, an exemplary embodiment of protective sporting gear as a sports girdle 300 is shown. The sport girdle 300 includes patterned sheets of material 110 (e.g., compression/wicking fabric) that collectively form an outer boxer brief shape. The sport girdle 300 covers the hip and upper thigh areas of the athlete. The inner surface (not shown) of the first layer of material 110 may include padding for additional protection while the protective hexagons 120 are positioned on an outer surface of the first layer of material 110 with optionally one or more layers of material (not shown) positioned over at least some or all of the protective hexagons 120.

Figure 3A:
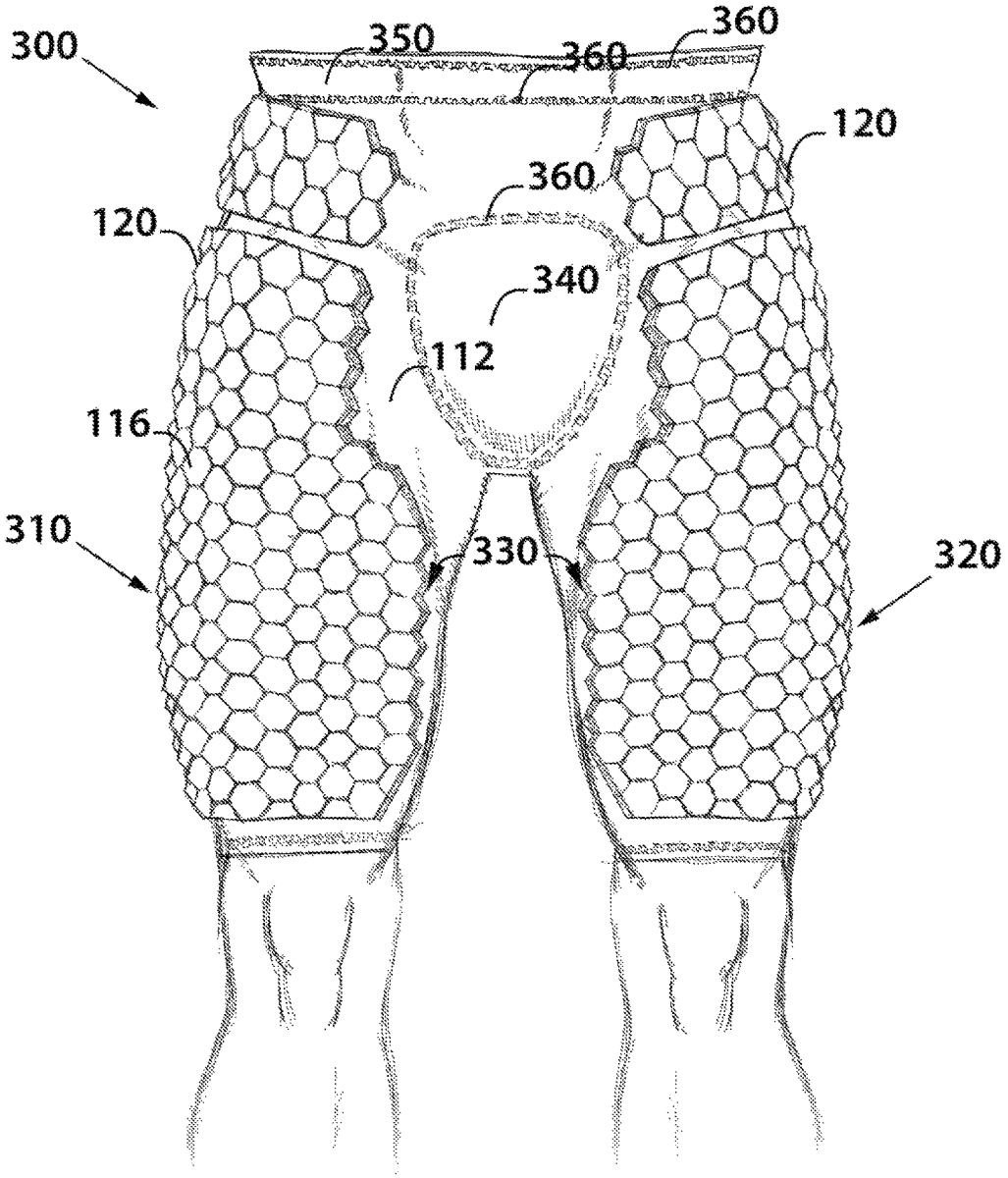
FIGS. 3A-3D are exemplary embodiments of the protective components of FIGS. 1A-1D implemented as part of a sports girdle.

As shown in FIG. 3A, the sport girdle 300 may include a pattern of protective hexagons 120 with their foam portions being attached to the first layer of material 110. Herein, the protective hexagons 120 may be positioned over a majority (e.g., greater than 70%) of a first leg portion 310 and a second leg portion 320 of the sport girdle 300. In particular, the protective hexagons 120 are located to cover at least a portion of a thigh area 330 of the sport girdle 300.

The protective hexagons 120 can be attached completely or at least partially covering the first layer of material 110, depending on what degree of protection and area is needed. As an example, for an athlete playing cricket, the protective hexagons 120 may be oriented to cover a portion of the batsman's thigh that is facing the bowler. A similar construction may be conducted when the sports girdle 300 is directed to baseball, along with additional padding that is located to reduce an impact caused by sliding. In contrast, for ice or roller hockey, the protective hexagons 120 may be positioned over a greater amount of surface area of the first layer of material 110 than for a girdle directed to another sport such as cricket or baseball for example.

Besides the protective hexagons 120, the first layer of material 110 forming the sports girdle 300 may include a pouch 340 to hold and secure an athletic cup. Velcro® (not shown) may be used to keep the pouch 340 closed. Also, the protective hexagons 120 can also be taller or shorter, or, harder or softer depending on the sport and users preference. As further shown, an elastic waist band 350 is sewn into a top opening of the sports girdle 300 to help keep the sports girdle 300 in place. Similar elastic bands may be located at the end of the first leg portion 310 and the second leg portion 320. As stated above, flat stitching 360 would be used where sewing is needed to minimize or eliminate skin discomfort.

Figure 3B:
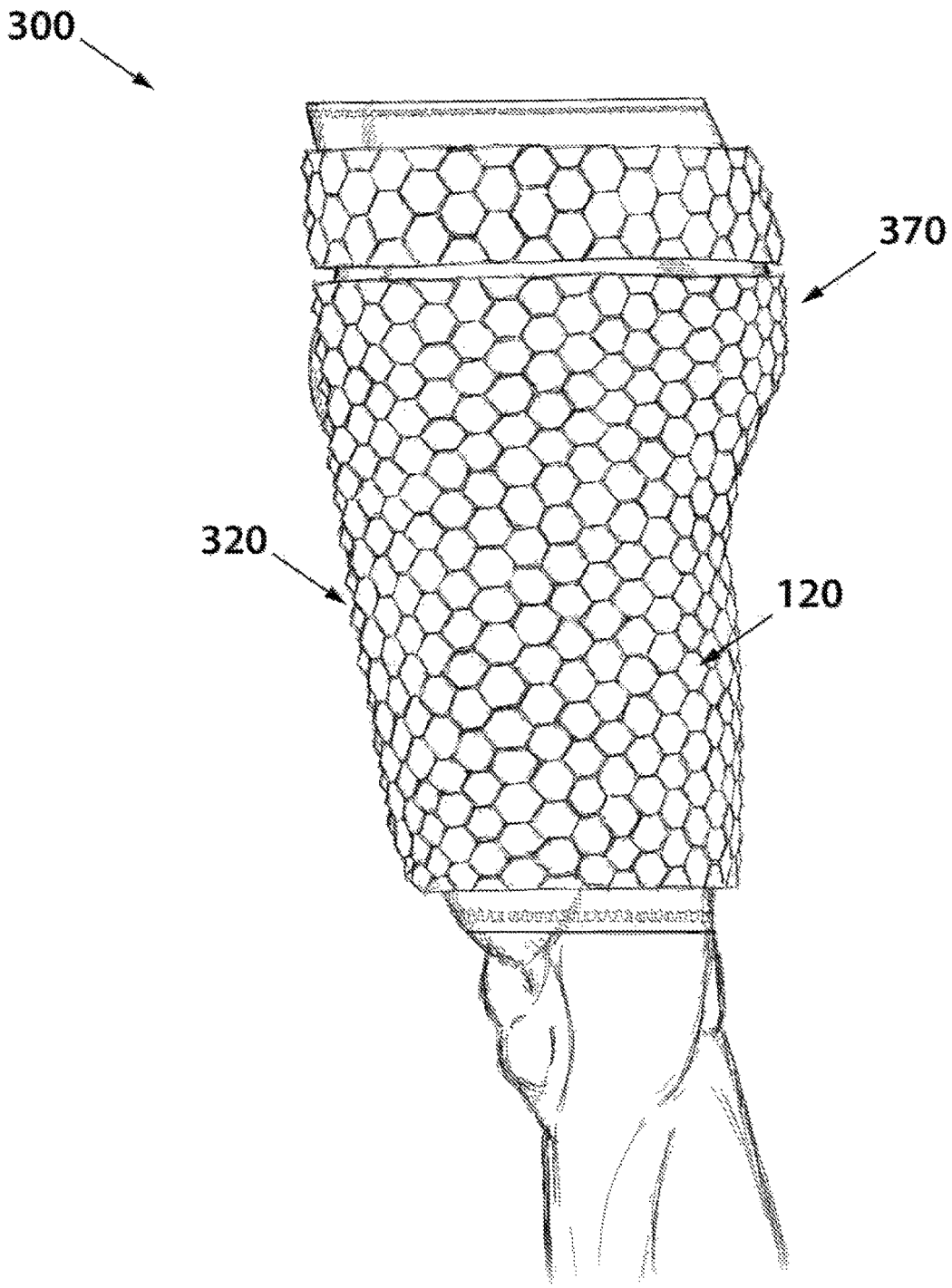
Figure 3C:
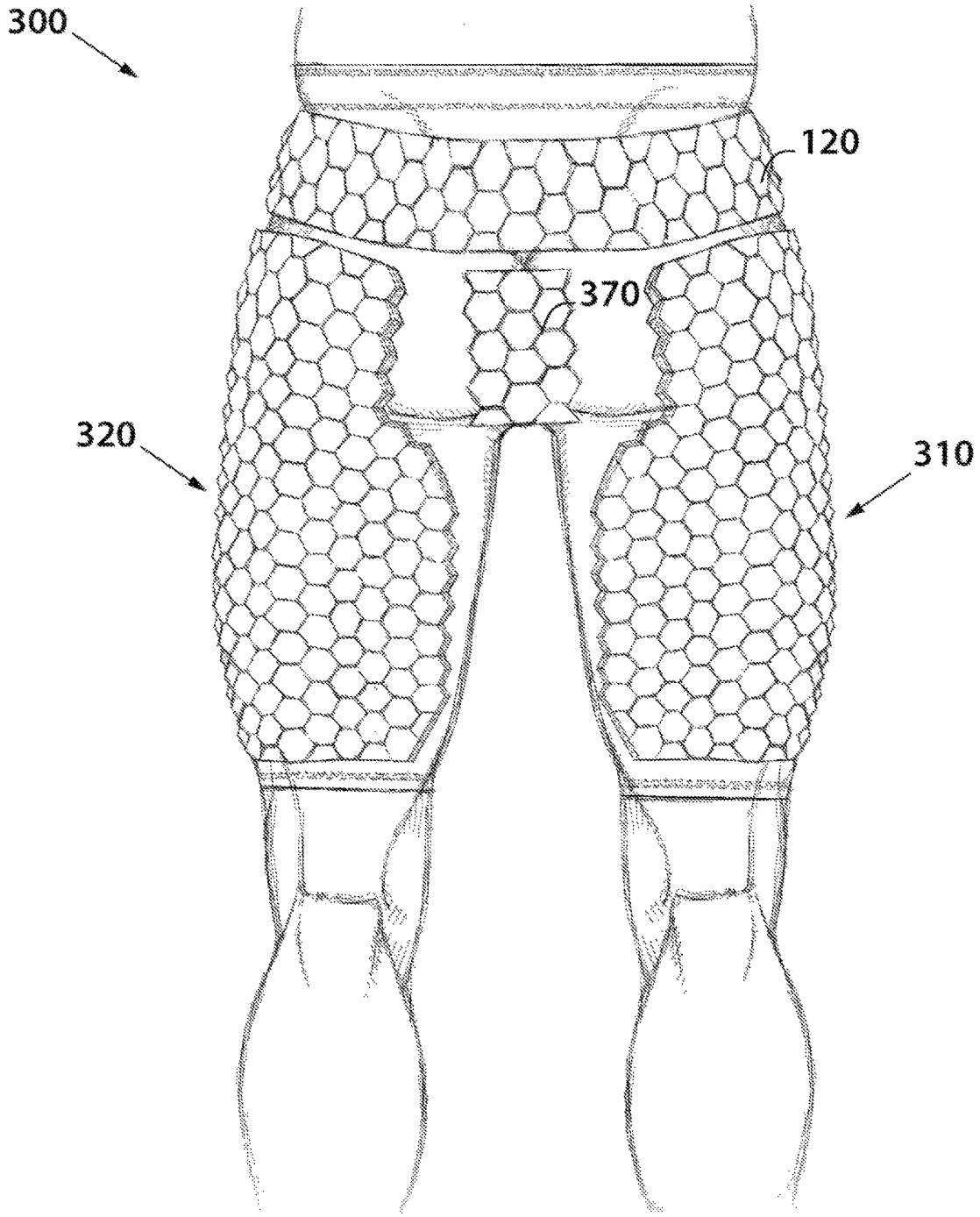
Figure 3D:
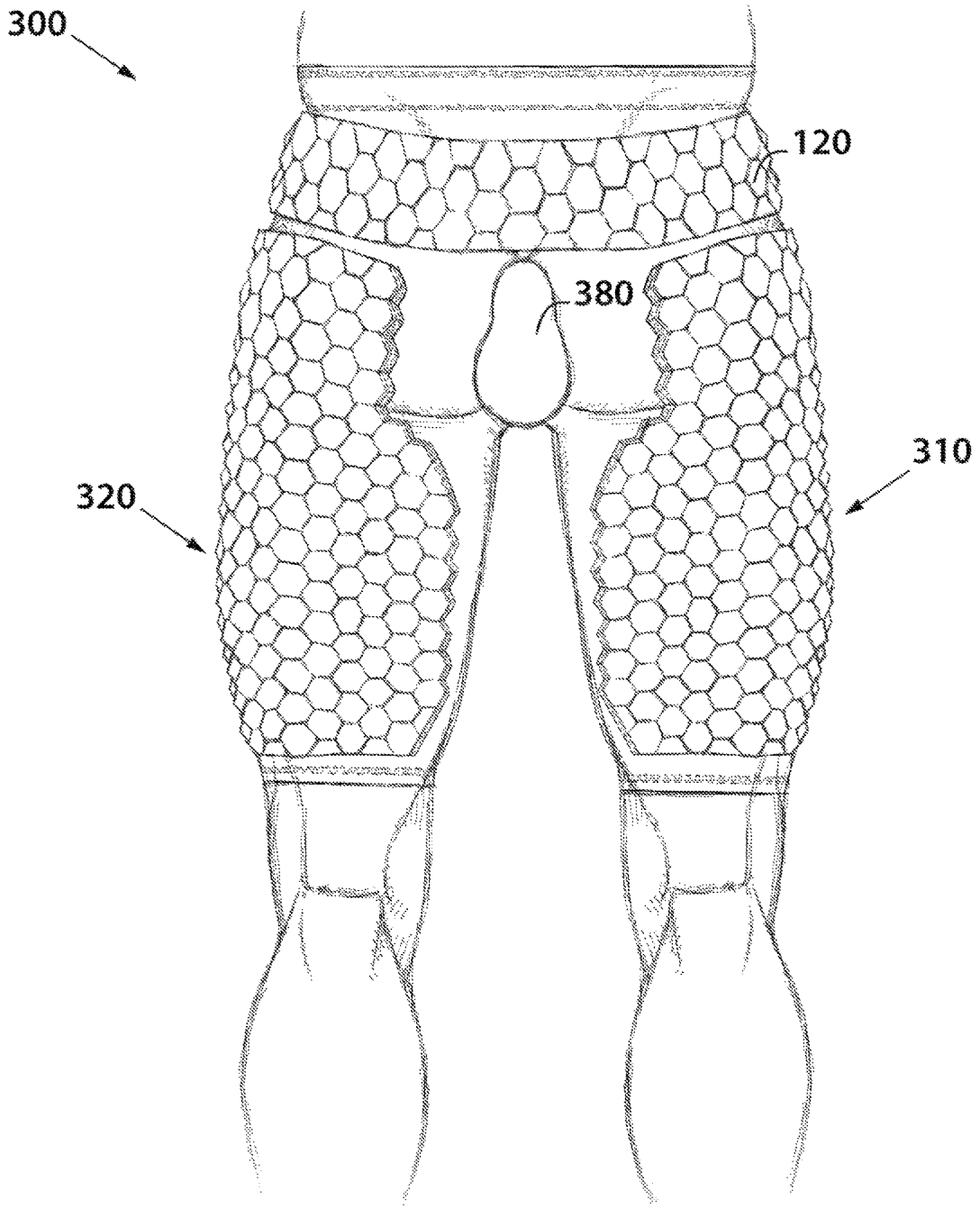

As shown in FIGS. 3B-3C, protective hexagons 370 may be attached to the first layer of material 110 to aid in the protection of the coccyx (tail bone.). The sizing of the protective hexagons 370 may be larger in area and overall dimension than the protective hexagons 120. The sizing may be larger as the degree of flexibility needed at the coccyx location is limited, unlike the flexibility needed at the knee area. Of course, as shown in FIG. 3D, the tail bone protective component may also include a custom shaped (non-hexagonal and single piece) component 380 as shown, where the component may still be constructed with the rigid and non-rigid material layering as described in FIGS. 1A-1D.

IV. Protective Tights

Referring now to FIGS. 4A-4D, an exemplary embodiment of protective sporting gear as a full-legged tights 400 is shown. The tights 400 includes patterned sheets of fabric (e.g., compression/wicking fabric) that collectively form a full-legged thermal pants shape. The tights 400 generally operate as collective protection offered by the knee/shin protector 200 of FIGS. 2A-2C and the sports girdle 300 of FIGS. 3A-3D. Different areas along the inner surface (not shown) of the first layer of the material 110 may include padding for additional protection while the protective hexagons 120 are positioned on the top surface 112 of the first layer of the material 110. Although not shown, one or more layers of material may be positioned so that the protective hexagons 120 are positioned between these one or more layers of material and the first layer of material 110.

Figure 4A:
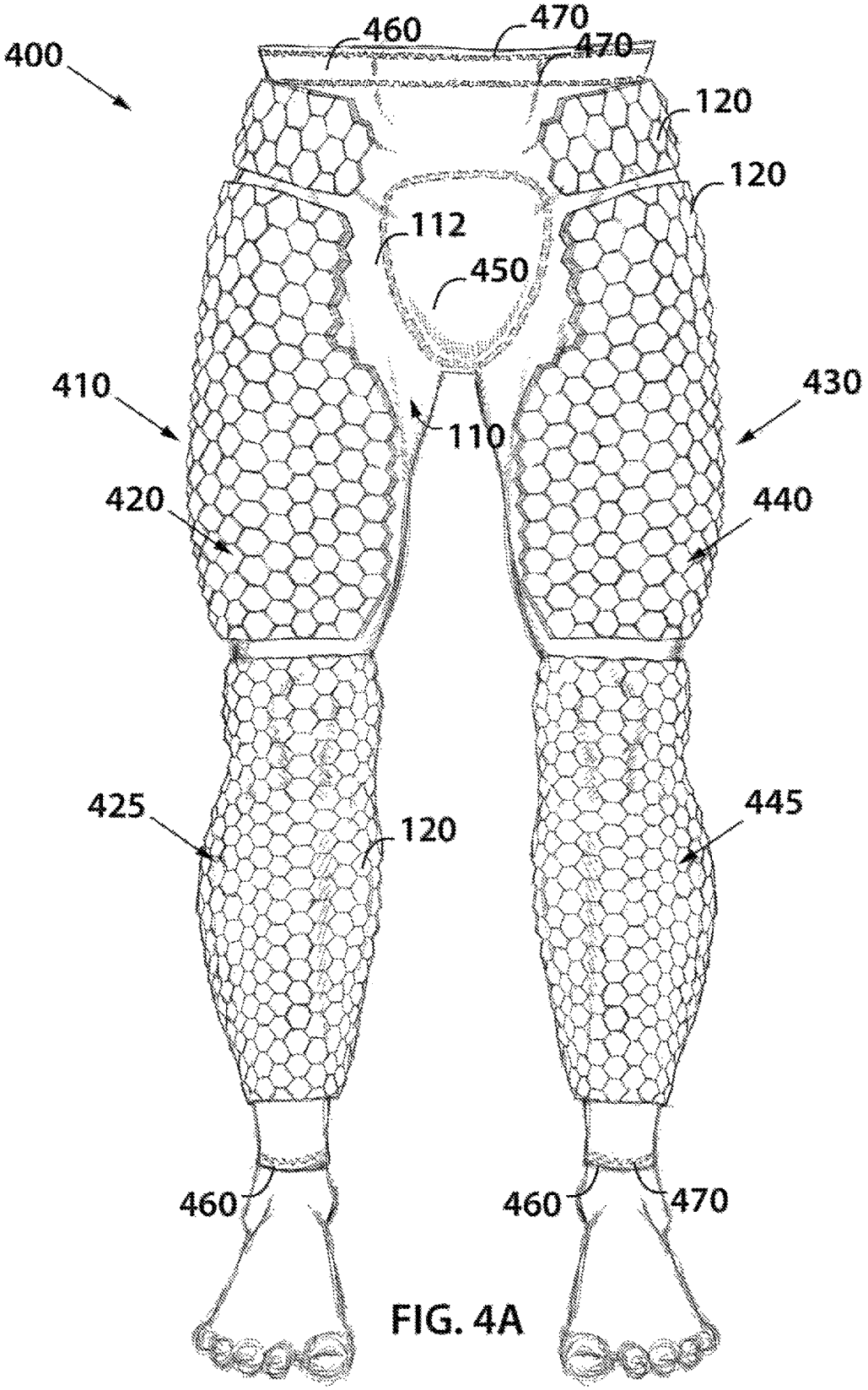
FIGS. 4A-4D are exemplary embodiments of the protective components of FIGS. 1A-1D implemented as part of full-legged tights.

As shown in FIG. 4A, the tights 400 may include a pattern of protective hexagons 120 with their foam portions being attached to the top surface 112 of the first layer of material 110. Herein, the protective hexagons 120 may be positioned over a substantial part (e.g., greater than 70%) of a first leg portion 410 and/or a second leg portion 430. The first leg portion 410 includes a first thigh portion 420 and a first shin portion 425. The second leg portion 430 includes a second thigh portion 440 and a second shin portion 445.

Besides the protective hexagons 120, the first layer of material 110 forming the tights 400 may include a pouch 450 to hold and secure an athletic cup. Velcro® (not shown) may be used to keep the pouch 450 closed. Also, the protective hexagons 120 can also be taller or shorter, or, harder or softer depending on the sport and users preference. As further shown, an elastic waist band 460 is sewn into a top opening of the tights 400 to help keep the tights 400 in place. Similar elastic bands may be located at the end of the first leg portion 410 and the second leg portion 430. Again, flat stitching 470 would be used where sewing is needed to minimize or eliminate skin discomfort proximate to the elastic bands.

Figure 4B:
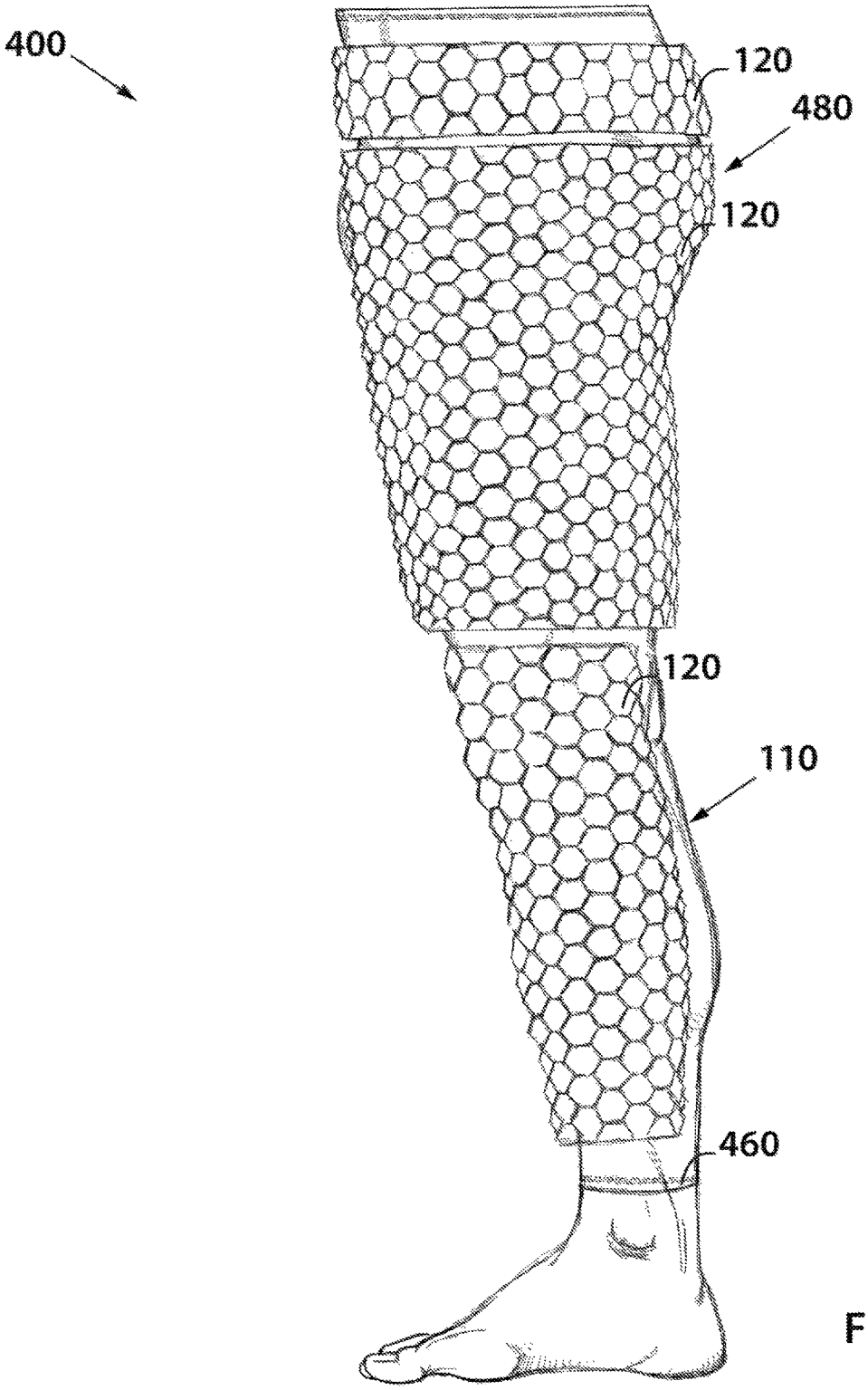
Figure 4C:
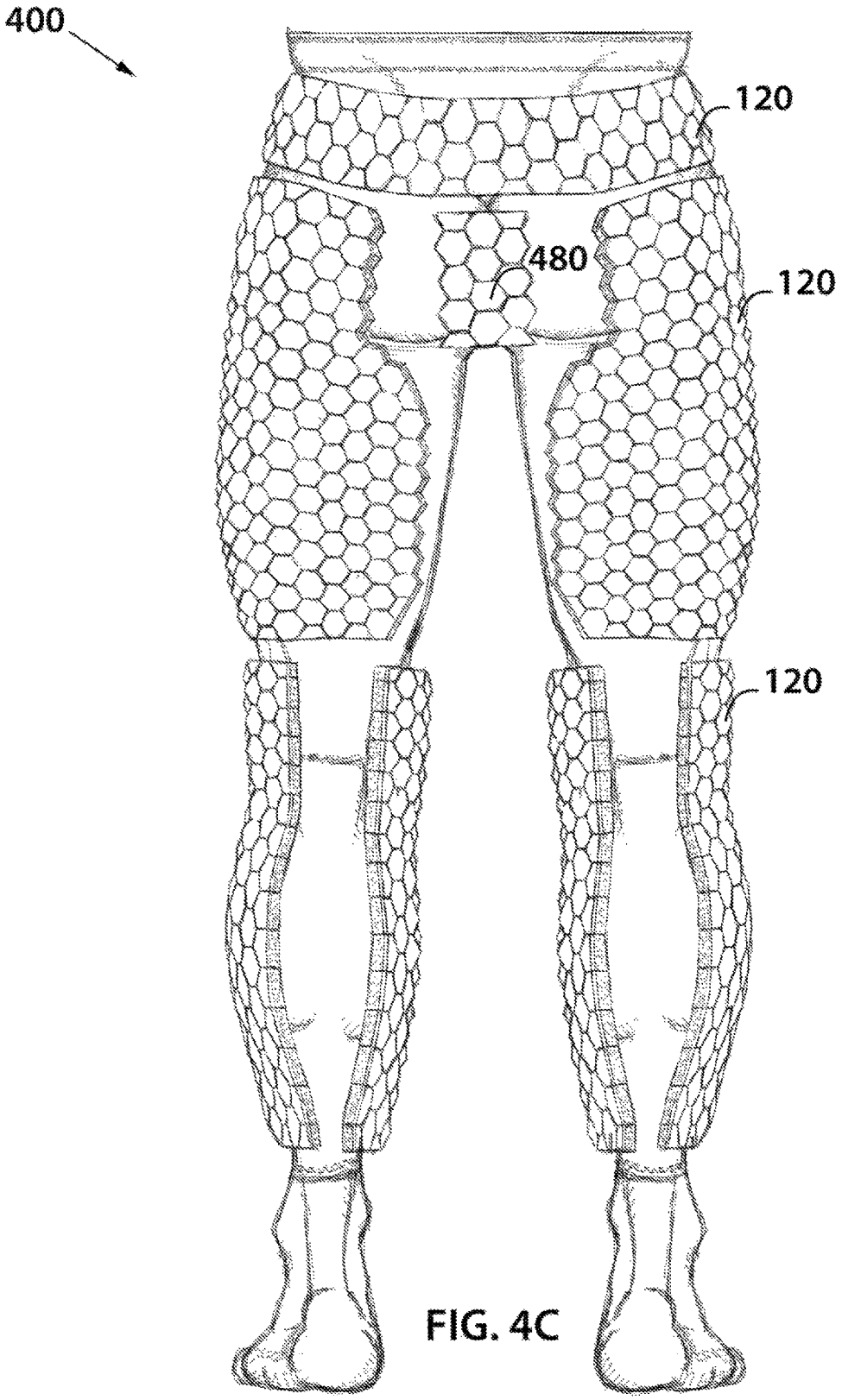
Figure 4D:
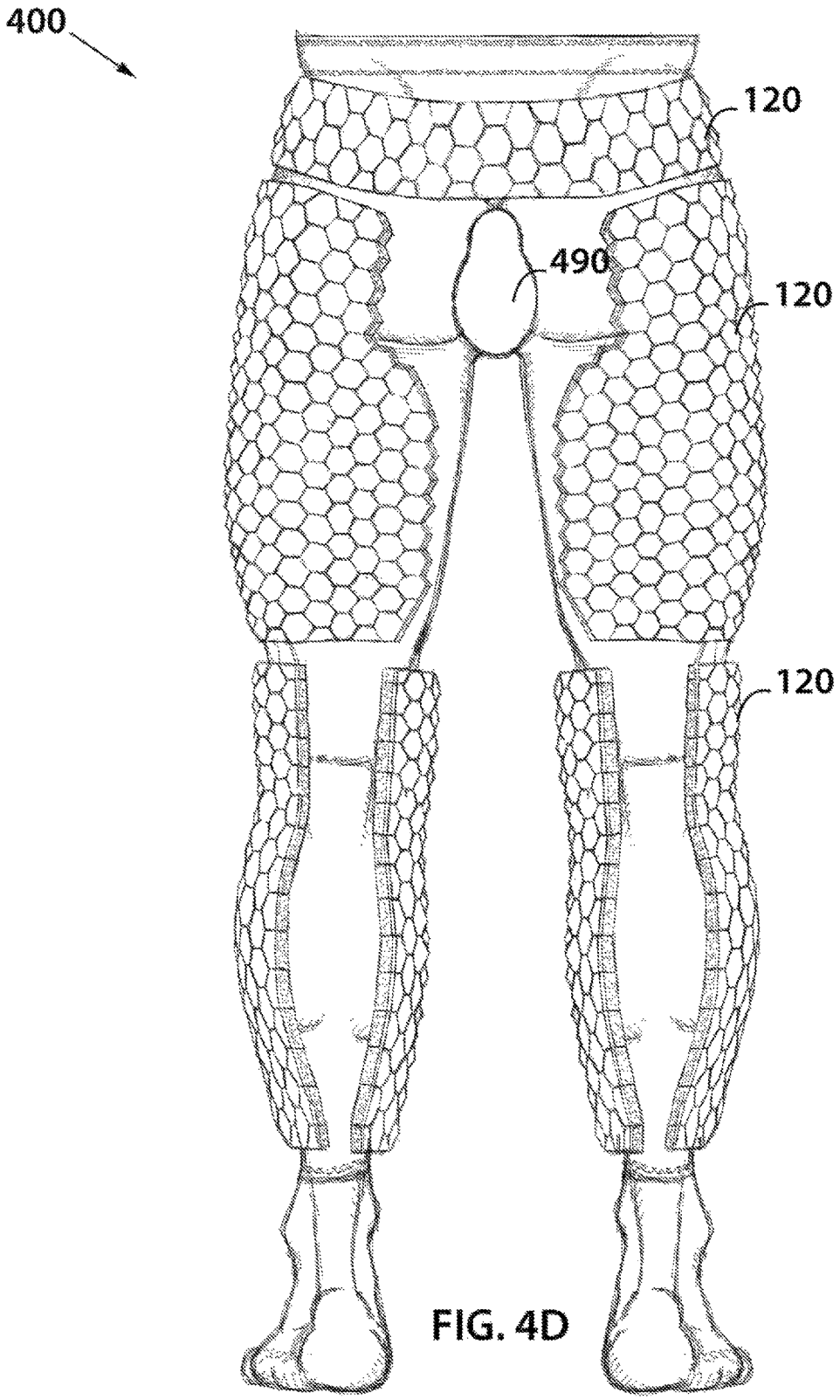

As shown in FIGS. 4B-4C, protective hexagons 480 may be attached to the first layer of the material 110 to aid in the protection of the coccyx (tail bone.). As previously stated, the sizing of the protective hexagons 480 may be larger in area and overall dimension than the protective hexagons 120. The sizing may be larger since the degree of flexibility needed at the coccyx location is limited, unlike the flexibility needed at the knee area for example. Of course, as shown in FIG. 4D, the tail bone protective component may also include a custom shaped (non-hexagonal) component 490 as shown where, as an optional feature, the component may be constructed with the rigid and non-rigid material layering as described in FIGS. 1A-1D.

V. Protective Arm Sleeve

Figure 5A:
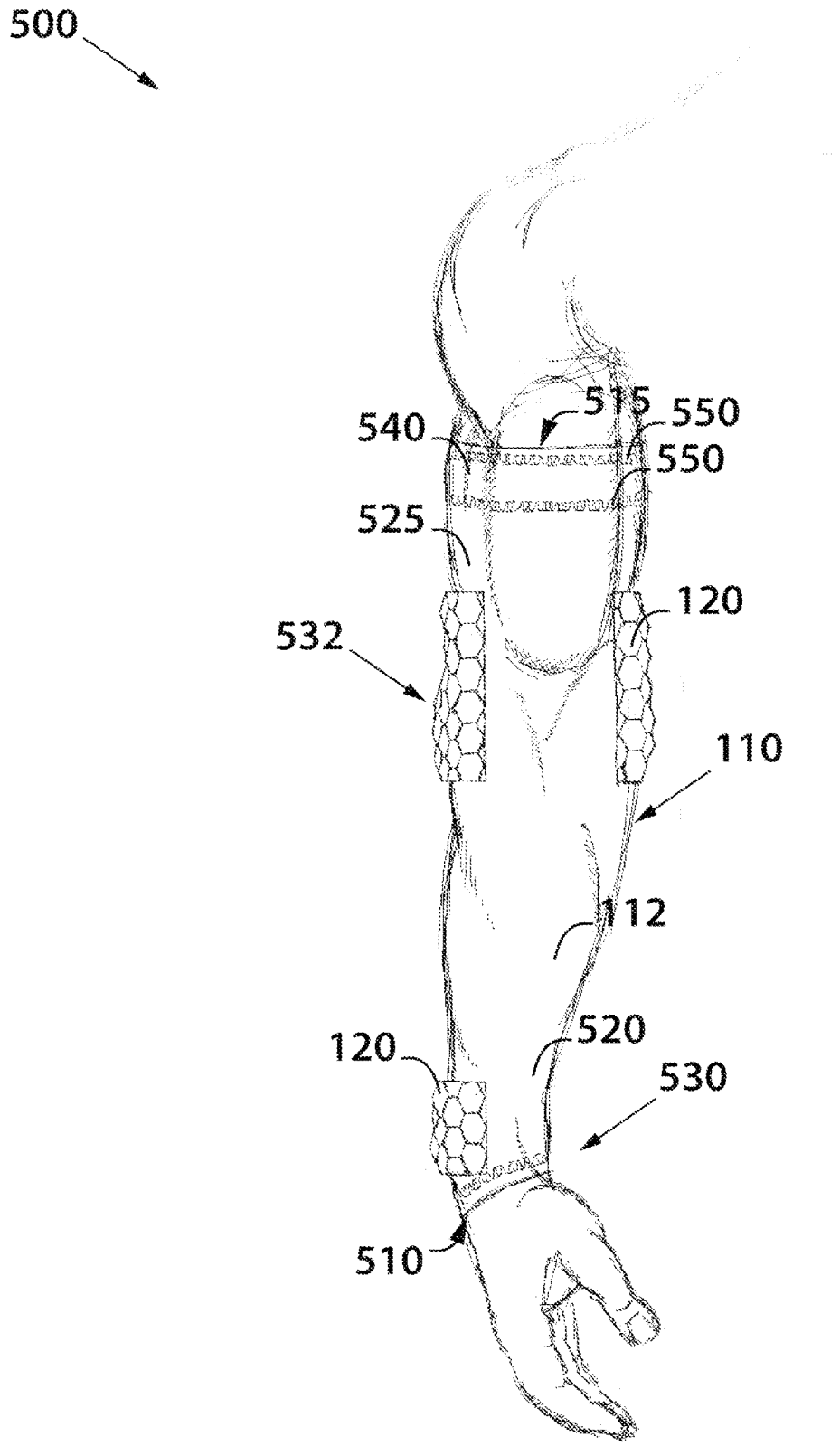
FIGS. 5A-5C are exemplary embodiments of the protective components of FIGS. 1A-1D implemented as part of an arm sleeve.
Figure 5B:
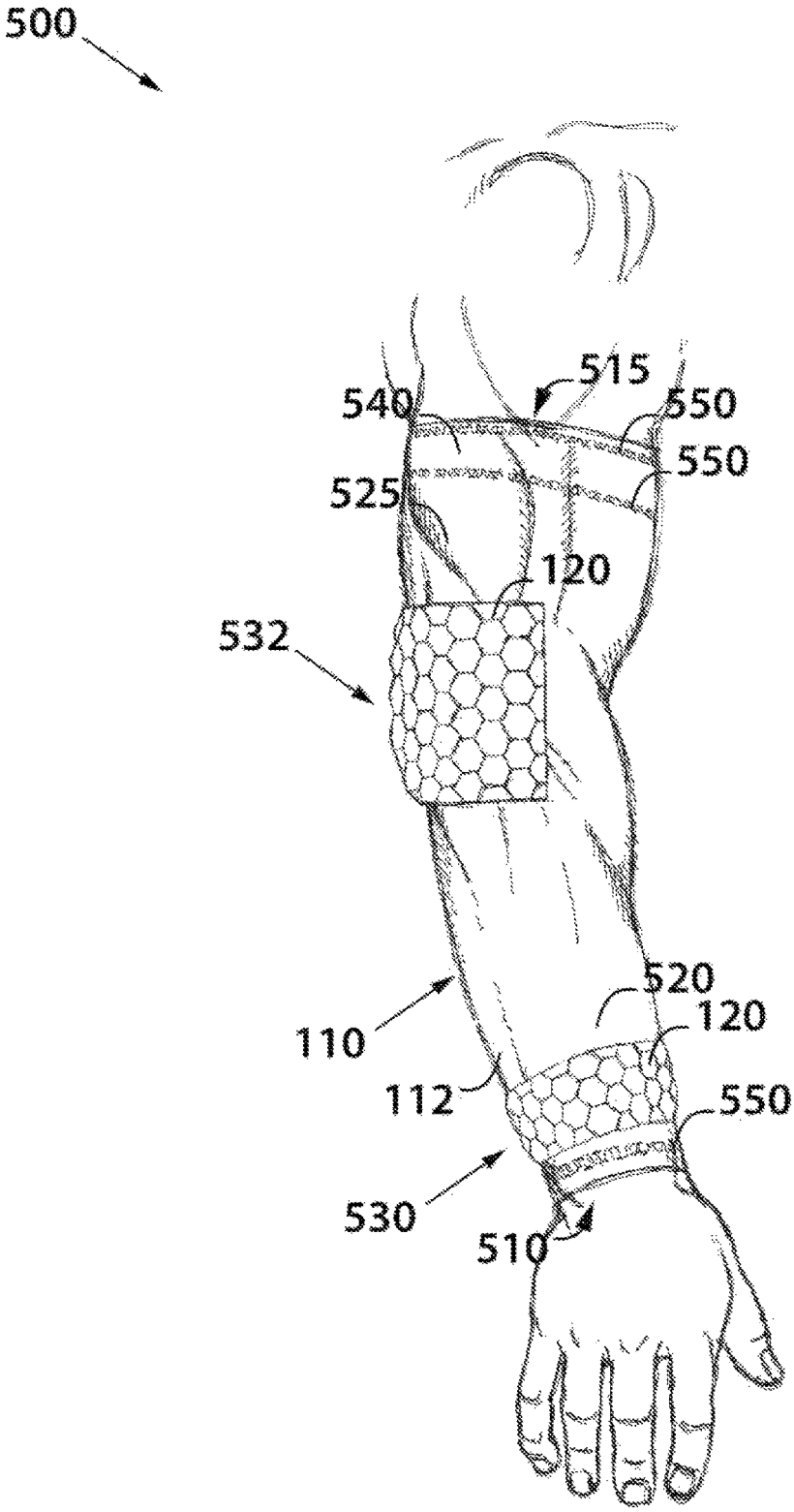
Figure 5C:
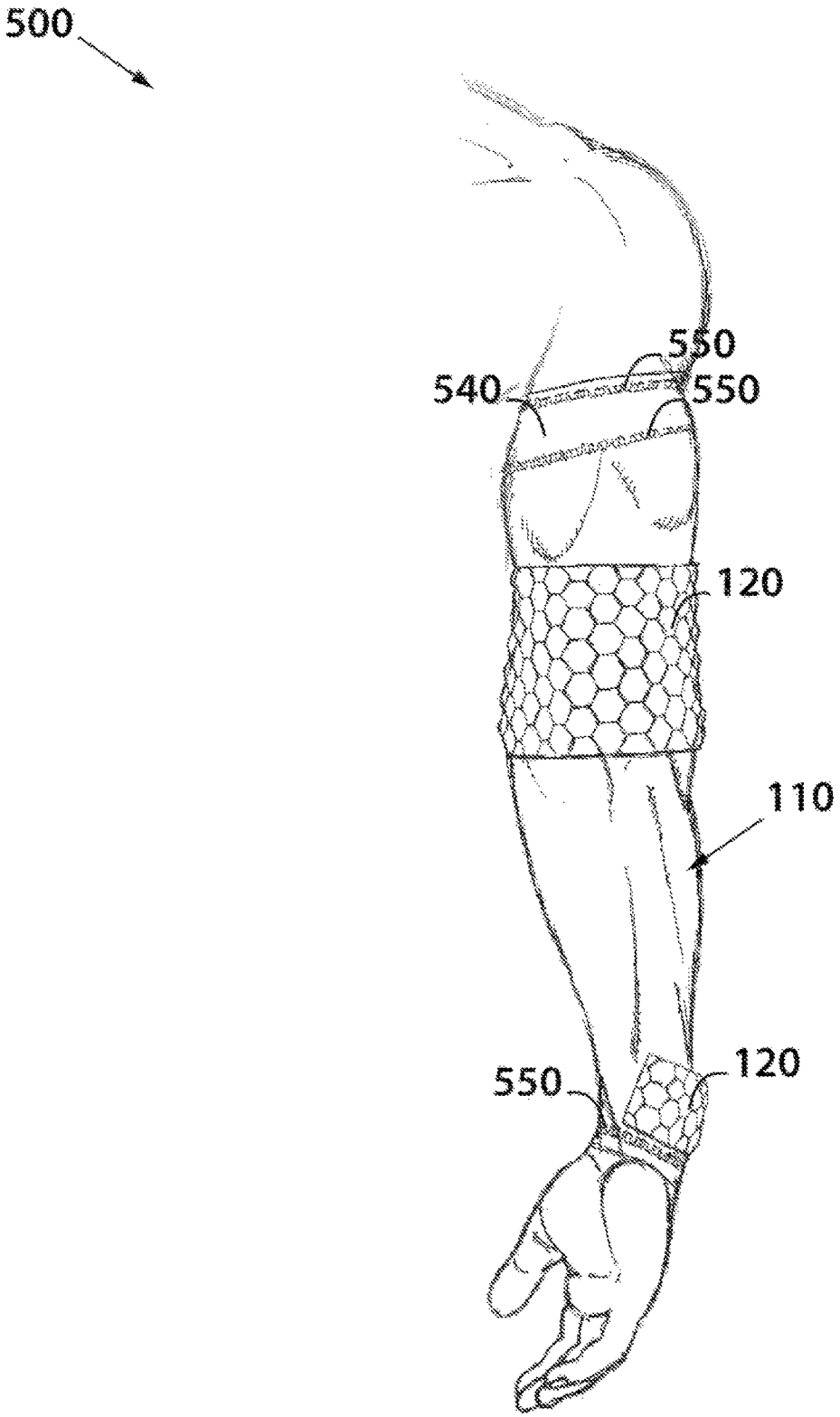

Referring now to FIGS. 5A-5C, an exemplary embodiment of protective sporting gear as an arm sleeve 500 is shown. Similar to the embodiments set forth above, the arm sleeve 500 includes the first layer of the material 110 (e.g., compression/wicking fabric) that collectively forms a cylindrical shape having a first opening 510 and a second opening 515. The first opening 510 may be sized with a smaller diameter than the second opening 515 because a first portion 520 of the arm sleeve 500 proximate to the first opening 510 is to be positioned around a lower arm (e.g., proximate to a wrist area of the arm) while a second portion 525 of the arm sleeve 500 is to be positioned around an upper arm (e.g., proximate to a bicep area of the arm).

As shown, the protective hexagons 120 may be attached (e.g., sewn, glued, welded, or any other adhesion scheme) completely or partially covering the first layer of the material 110 (first sheet of fabric), depending on what degree of protection and area is needed. As shown in FIGS. 5A-5C, the protective hexagons 120 can be concentrated near the wrist area 530, elbow area 532 or other areas of the arm. However, it is contemplated that the protective hexagons 120 may be positioned at different areas along the arm sleeve 500, where the location may be dependent on the type of sport associated with the arm sleeve 500. For instance, for baseball, it is contemplated that the protective hexagons 120 may be located along the portions of the arm sleeve 500 that cover and protect an elbow portion of a batter's arm.

Although not shown, the second layer of material (second sheet of fabric) may be provided. Herein, the second layer may be attached to the first layer of material 110 that is forming the arm sleeve 500. As a result, the protective hexagons 120 would reside between the first and second layers that collectively form the arm sleeve 500. The second layer, when provided, ensures that the protective hexagons 120 stay together, thereby controlling gaps and reinforcing compression. As described above, elastic bands 540 may be sewn into the first opening 510 and/or the second opening 515 of the arm sleeve 500 to help keep the arm sleeve 500 in place. Flat stitching 550 would be used where sewing is needed to minimize or eliminate skin discomfort.

VI. Protective Shirt

Figure 6A:
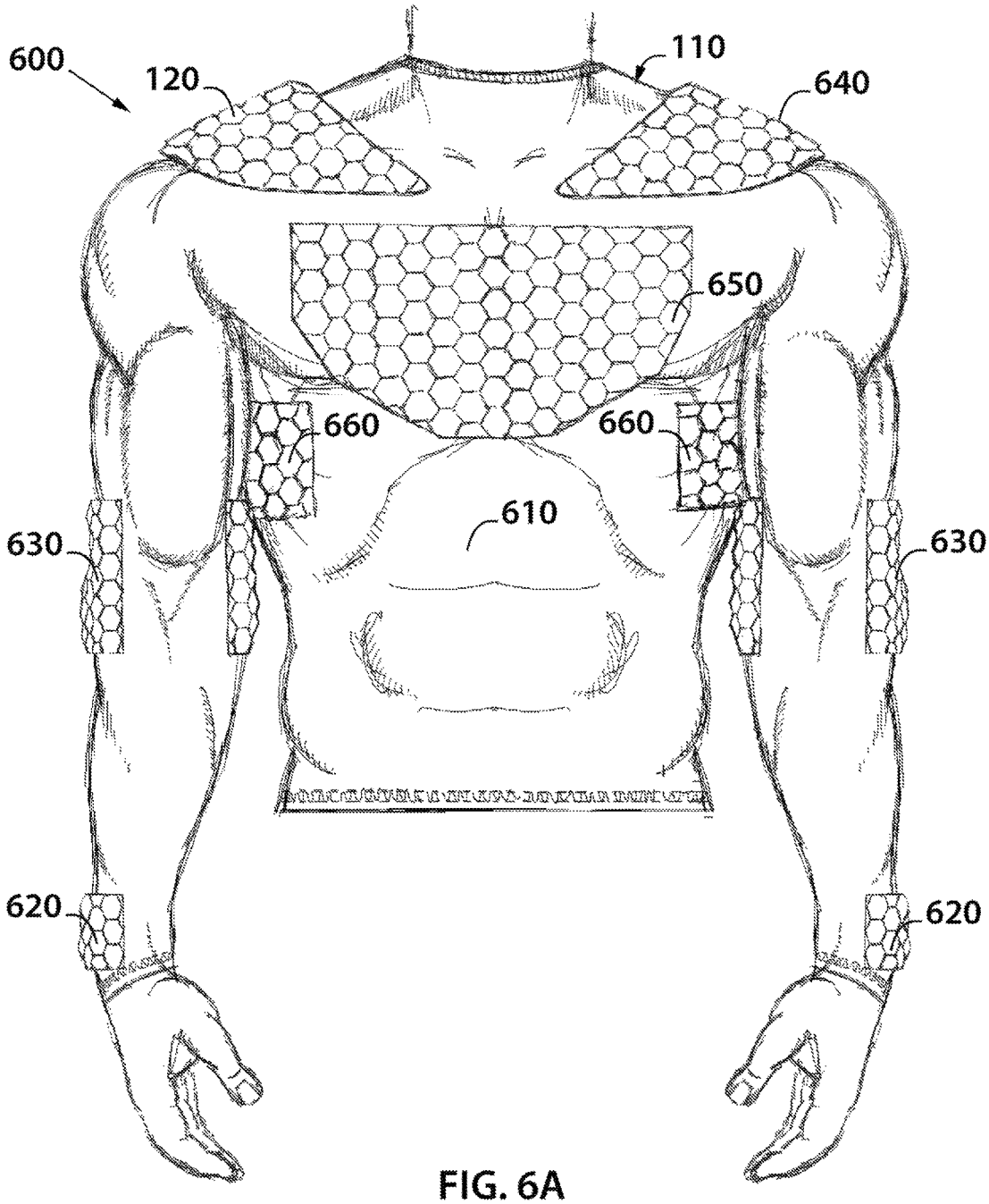
FIGS. 6A-6C are exemplary embodiments of the protective components of FIGS. 1A-1D implemented as part of a protective shirt.
Figure 6B:
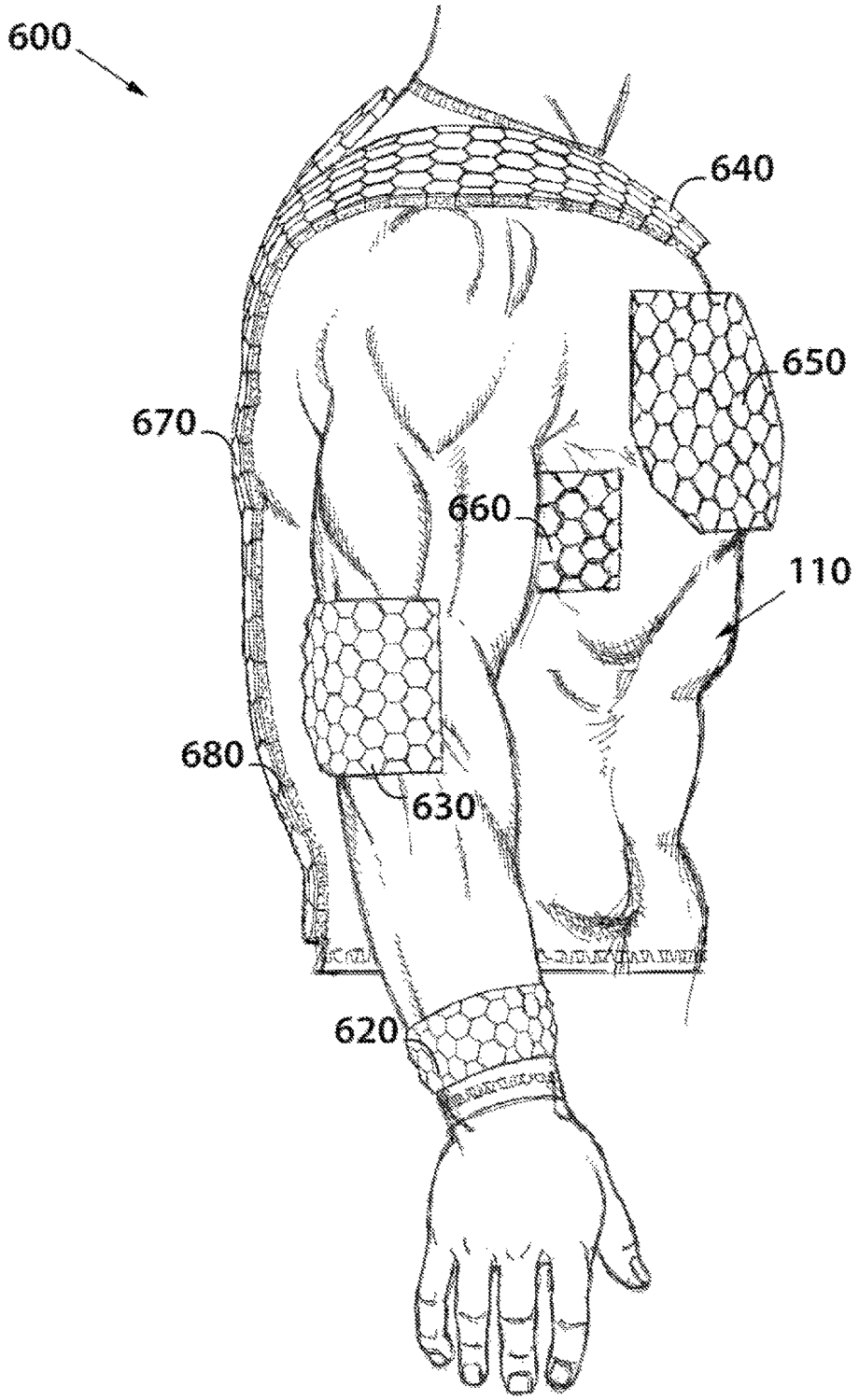
Figure 6C:
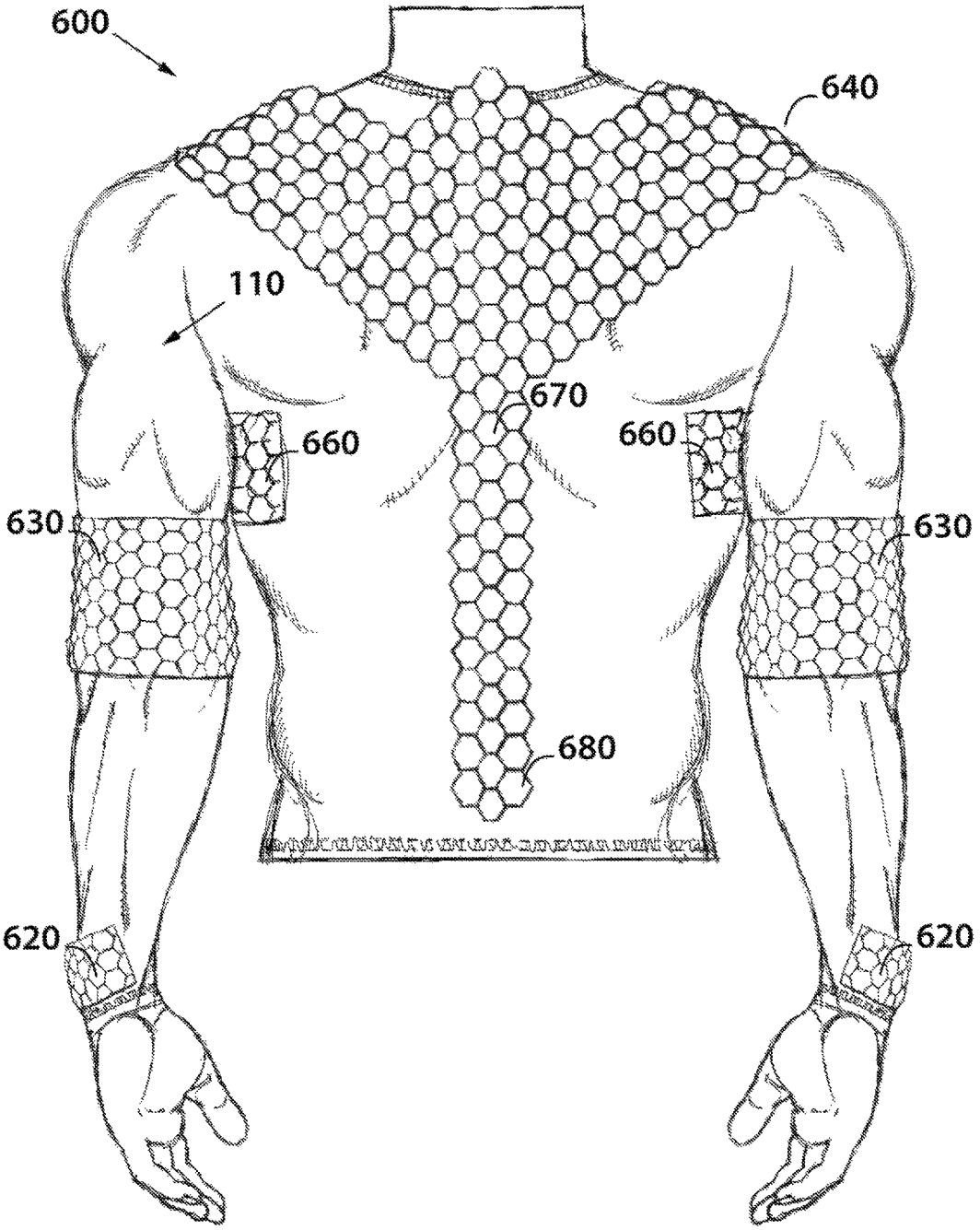

Referring now to FIGS. 6A-6C, an exemplary embodiment of sporting gear as a protective shirt 600 is shown. According to one embodiment, the protective shirt 600 includes an outer compression/wicking fabric as a shirt (not shown) and one or more inner pieces/sheets of compression/wicking fabric 110. The inner pieces/sheets of fabric 110 may have a shirt shape, thereby corresponding to an inner lining of a two-ply protective shirt 600. Of course, it is contemplated that the fabric 110 may be multiple pieces/sheets, where each of these pieces/sheets are attached to the outer compression/wicking shirt (not shown) based on the selected locations selected for the protective hexagons 120.

More generally stated, the protective shirt 600 includes the first layer of material 110 (e.g., compression/wicking fabric) shaped in a sleeveless shirt, a short-sleeved shirt, or a long-sleeved shirt as shown. The protective hexagons 120 may be attached completely or partially covering the first layer of material 110, depending on what degree of protection is needed for the particular sport. As shown, the protective hexagons 120 can be concentrated near the wrists 620, elbows 630 (if long-sleeved shirt), clavicle 640, sternum/chest 650, ribs 660, spine 670 and/or small of back 680. The protective hexagons 620-680 can also be larger or smaller, the rigid and/or non-rigid material may be harder or softer depending on the sport associated with the shirt, their location, and users preference.

Although not shown, it is contemplated that the second layer of material may be attached (e.g., sewn, glued, welded, etc.) to the first layer of the material 110. The second layer of material ensures that the protective hexagons 120 stay together, thereby controlling gaps and reinforcing compression. In contrast with traditional protective shirts, the protective shirt 600 is easily washable.

What is claimed is:

1. A protective sporting gear, comprising:

a first layer of material;

a plurality of polygon-shaped protective components attached to a top surface of the first layer of material, each of the plurality of polygon-shaped protective components is independent of and decoupled from neighboring protective components of the plurality of polygon-shaped protective components and comprises one or more polygon-shaped layers of rigid material situated on one or more polygon-shaped layers of non-rigid material with a bottom surface of a first polygon-shaped layer of non-rigid material of the one or more polygon-shaped layers of non-rigid material being attached to the top surface of the first layer of material; and a second layer of material positioned over the plurality of polygon-shaped protective components so that the plurality of polygon-shaped protective components is interposed between the first layer of material and the second layer of material.

2. The protective sporting gear of claim 1, wherein a top surface of the first polygon-shaped layer of non-rigid material is coupled to a bottom surface of a first polygon-shaped layer of rigid material of the one or more polygon-shaped layers of rigid material having an area less than or equal to an area of the first polygon-shaped layer of non-rigid material.

3. The protective sporting gear of claim 1, wherein both the first layer of material and the second layer of material are compression fabric.

4. The protective sporting gear of claim 1, wherein the first layer of material includes a compression fabric that wicks moisture from an inner side of the compression fabric to an outer side of the compression fabric for evaporation.

5. The protective sporting gear of claim 4, wherein at least one of the one or more polygon-shaped layers of rigid material includes a light-weight composite material and at least one of the one or more polygon-shaped layers of non-rigid material includes a foam.

6. The protective sporting gear of claim 5, wherein each of the plurality of polygon-shaped protective components are patterned in a hexagon-shape so that the plurality of polygon-shaped protective components correspond to a plurality of hexagon-shaped protective components and a first side of a first hexagon-shaped protective component of the plurality of hexagon-shaped protective components is aligned and in parallel with a first side of a second hexagon-shaped protective component of the plurality of hexagon-shaped protective components.

7. The protective sporting gear of claim 1, wherein a top surface of the first polygon-shaped layer of non-rigid material is coupled to a bottom surface of a second polygon-shaped layer of non-rigid material, and a top surface of the second polygon-shaped layer of non-rigid material is coupled to a bottom surface of a first polygon-shaped layer of rigid material of the one or more polygon-shaped layers of rigid material having an area less than or equal to an area of the first polygon-shaped layer of non-rigid material and the second polygon-shaped layer of non-rigid material.

8. The protective sporting gear of claim 1 being one of a knee/shin protector, a sports girdle, an arm sleeve or a shirt.

9. A protective sporting gear, comprising:

a fabric including a top surface and a bottom surface;

a plurality of polygon-shaped protective components independent of and decoupled from neighboring protective components of the plurality of polygon-shaped protective components and attached to the top surface of the fabric, each of the plurality of polygon-shaped protective components comprises one or more polygon-shaped layers of rigid material having a perimeter aligned with and corresponding to one or more polygon-shaped layers of non-rigid material, wherein a bottom surface of a first polygon-shaped layer of non-rigid material of the one or more polygon-shaped layers of non-rigid material being attached to the top surface of the fabric.

10. The protective sporting gear of claim 9, wherein each of the plurality of polygon-shaped protective components includes a plurality of sides adjacent to corresponding sides of at least two neighboring polygon-shaped protective components of the plurality of polygon-shaped protective components.

11. The protective sporting gear of claim 9, wherein the fabric includes a compression fabric that wicks moisture from an inner side of the compression fabric to an outer side of the compression fabric for evaporation.

12. The protective sporting gear of claim 9, wherein the one or more polygon-shaped layers of rigid material includes a light-weight composite material.

13. The protective sporting gear of claim 12, wherein the one or more polygon-shaped layers of non-rigid material includes a foam.

14. The protective sporting gear of claim 13, wherein each of the plurality of polygon-shaped protective components are patterned in a hexagon-shape so that the plurality of polygon-shaped protective components correspond to a plurality of hexagon-shaped protective components.

15. The protective sporting gear of claim 14, wherein a first side of a first hexagon-shaped protective component of the plurality of hexagon-shaped protective components is aligned and in parallel with a first side of a second hexagon-shaped protective component of the plurality of hexagon-shaped protective components.

16. The protective sporting gear of claim 15 being one of a knee/shin protector, a sports girdle, or an arm sleeve.

17. A protective sporting gear, comprising:

a first layer of material including a top surface and a bottom surface;

a plurality of hexagon-shaped protective components attached to the top surface of the first layer of material, each of the plurality of protective components comprises a hexagon-shaped layer of rigid material having a perimeter vertically aligned with and corresponding to a hexagon-shaped layer of non-rigid material independent of and decoupled from one or more neighboring protective components of the plurality of polygon-shaped protective components, wherein a bottom surface of the hexagon-shaped layer of non-rigid material being is attached to the top surface of the first layer of material.

18. The protective sporting gear of claim 17, wherein each of the plurality of hexagon-shaped protective components includes a plurality of sides adjacent to corresponding sides of at least two neighboring hexagon-shaped protective components of the plurality of hexagon-shaped protective components.

19. The protective sporting gear of claim 17, wherein the hexagon-shaped layer of rigid material includes a light-weight composite material and the hexagon-shaped layer of non-rigid material includes a foam.

20. The protective sporting gear of claim 19, wherein an area of the hexagon-shaped layer of rigid material is less than an area of the hexagon-shaped layer of non-rigid material.

* * * * *